US010257632B2

(12) United States Patent
Kordon et al.

(10) Patent No.: US 10,257,632 B2
(45) Date of Patent: Apr. 9, 2019

(54) METHOD FOR FRAME-WISE COMBINED DECODING AND RENDERING OF A COMPRESSED HOA SIGNAL AND APPARATUS FOR FRAME-WISE COMBINED DECODING AND RENDERING OF A COMPRESSED HOA SIGNAL

(71) Applicant: DOLBY LABORATORIES LICENSING CORPORATION, San Francisco, CA (US)

(72) Inventors: Sven Kordon, Wunstorf (DE); Alexander Krueger, Hannover (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/751,255

(22) PCT Filed: Mar. 1, 2016

(86) PCT No.: PCT/EP2016/054317

§ 371 (c)(1),
(2) Date: Feb. 8, 2018

(87) PCT Pub. No.: WO2017/036609

PCT Pub. Date: Mar. 9, 2017

(65) Prior Publication Data

US 2018/0234784 A1 Aug. 16, 2018

(30) Foreign Application Priority Data

Aug. 31, 2015 (EP) ..... 15306334

(51) Int. Cl.

| | |
|---|---|
| ***G10L 19/008*** | (2013.01) |
| ***H04S 3/00*** | (2006.01) |
| ***H04S 3/02*** | (2006.01) |

(52) U.S. Cl.
CPC ..... *H04S 3/008* (2013.01); *G10L 19/008* (2013.01); *H04S 3/02* (2013.01); *H04S 2420/11* (2013.01)

(58) Field of Classification Search
None
See application file for complete search history.

(56) References Cited

U.S. PATENT DOCUMENTS

2015/0213803 A1* 7/2015 Peters ..... G10L 19/002 704/500

FOREIGN PATENT DOCUMENTS

| | | |
|---|---|---|
| EP | 2665208 | 11/2013 |
| EP | 2743922 | 6/2014 |
| EP | 2800401 | 11/2014 |

OTHER PUBLICATIONS

ISO/IEC JTC 1/SC 29 N ISO/IEC CD 23008-3 "Information Technology—High Efficiency Coding and Media Delivery in Heterogenous Environments—Part 3: 3D Audio" Apr. 4, 2014, pp. 143-215.

(Continued)

*Primary Examiner* — James K Mooney

(57) ABSTRACT

Higher Order Ambisonics (HOA) signals can be compressed by decomposition into a predominant sound component and a residual ambient component. The compressed representation comprises pre-dominant sound signals, coefficient sequences of the ambient component and side information. For efficiently combining HOA decompression and HOA rendering to obtain loudspeaker signals, combined rendering and decoding of the compressed HOA signal comprises perceptually decoding the perceptually coded portion and decoding the side information, without reconstructing HOA coefficient sequences. For reconstructing components of a first type, fading of coefficient sequences is not required, while for components of a second type fading is required.

(Continued)

For each second type component, different linear operations are determined: one for coefficient sequences that in a current frame require no fading, one for those that require fading-in, and one for those that require fading-out. From the perceptually decoded signals of each second type component, faded-in and faded-out versions are generated, to which the respective linear operations are applied.

9 Claims, 3 Drawing Sheets

(56) References Cited

OTHER PUBLICATIONS

"WD1-1-HOA Text of MPEG-H 3D Audio" MPEG Meeting San Jose, Jan. 13-17, 2014, pp. 21-41.

* cited by examiner

METHOD FOR FRAME-WISE COMBINED DECODING AND RENDERING OF A COMPRESSED HOA SIGNAL AND APPARATUS FOR FRAME-WISE COMBINED DECODING AND RENDERING OF A COMPRESSED HOA SIGNAL

FIELD

The present principles relate to a method for frame-wise combined decoding and rendering of a compressed HOA signal and to an apparatus for frame-wise combined decoding and rendering of a compressed HOA signal.

BACKGROUND

Higher Order Ambisonics (HOA) offers one possibility to represent 3-dimensional sound among other techniques, like wave field synthesis (WFS), or channel based approaches, like 22.2. In contrast to channel based methods, the HOA representation offers the advantage of being independent of a specific loudspeaker set-up. This flexibility, however, is at the expense of a rendering process which is required for the playback of the HOA representation on a particular loudspeaker set-up. Compared to the WFS approach, where the number of required loudspeakers is usually very large, HOA may also be rendered to set-ups consisting of only few loudspeakers. A further advantage of HOA is that the same signal representation that is rendered to loudspeakers can also be employed without any modification for binaural rendering to head-phones. HOA is based on the idea to equivalently represent the sound pressure in a sound source free listening area by a composition of contributions from general plane waves from all possible directions of incidence. Evaluating the contributions of all general plane waves to the sound pressure in the center of the listening area, i.e. the coordinate origin of the used system, provides a time and direction dependent function, which is then for each time instant expanded into a series of so-called Spherical Harmonics functions. The weights of the expansion, regarded as functions over time, are referred to as HOA coefficient sequences, which constitute the actual HOA representation. The HOA coefficient sequences are conventional time domain signals, with the specialty of having different value ranges among themselves. In general, the series of Spherical Harmonics functions comprises an infinite number of summands, whose knowledge theoretically allows a perfect reconstruction of the represented sound field. In practice, however, to arrive at a manageable finite amount of signals, the series is truncated, thus resulting in a representation of a certain order N. This determines the number O of summands for the expansion, as given by $O=(N+1)^2$. The truncation affects the spatial resolution of the HOA representation, which obviously improves with a growing order N. Typical HOA representations using order N=4 consist of 0=25 HOA coefficient sequences.

According to these considerations, the total bit rate for the transmission of HOA representation, given a desired single-channel sampling rate $f_S$ and the number of bits $N_b$ per sample, is determined by $0 \cdot f_S \cdot N_b$. Consequently, transmitting an HOA representation of order N=4 with a sampling rate of $f_S$=48 kHz and employing $N_b$=16 bits per sample results in a bit rate of 19.2 MBits/s, which is very high for many practical applications as e.g. streaming. Thus, compression of HOA representations is highly desirable.

Previously, the compression of HOA sound field representations was proposed in [2,3,4] and was recently adopted by the MPEG-H 3D audio standard [1, Ch.12 and Annex C.5]. The main idea of the used compression technique is to perform a sound field analysis and decompose the given HOA representation into a predominant sound component and a residual ambient component. The final compressed representation on the one hand comprises a number of quantized signals, resulting from the perceptual coding of the pre-dominant sound signals and relevant coefficient sequences of the ambient HOA component. On the other hand, it comprises additional side information related to the quantized signals, which is necessary for the reconstruction of the HOA representation from its compressed version.

One important criterion for the mentioned HOA compression technique of the MPEG-H 3D audio standard to be used within consumer electronics devices, be it in the form of software or hardware, is the efficiency of its implementation in terms of computational demand. In particular, for the playback of compressed HOA representations the efficiency of both, the HOA decompressor, which reconstructs the HOA representation from its compressed version, and the HOA renderer, which creates the loudspeaker signals from the reconstructed HOA representation, is of high relevance. To address that issue, the MPEG-H 3D audio standard contains an informative annex (see [1, Annex G]) about how to combine the HOA decompressor and the HOA renderer to reduce the computational demand for the case that the intermediately reconstructed HOA representation is not required. However, in the current version of the MPEG-H 3D audio standard the description is very difficult to comprehend and appears not fully correct. Further, it addresses only the case where certain HOA coding tools are disabled (i.e the spatial prediction for the predominant sound synthesis [1, Sec. 12.4.2.4.3] and the computation of the HOA representation of vector-based signals [1, Sec. 12.4.2.4.4] in case the vectors representing their spatial distribution have been coded in a special mode (i.e. CodedVVecLength=1).

SUMMARY

What is required is a solution for efficiently combining the HOA decompressor and HOA renderer in terms of computational demand, allowing the use of all HOA coding tools available in the MPEG-H 3D audio standard [1].

The present invention solves one or more of the above mentioned problems. According to embodiments of the present principles, a method for frame-wise combined decoding and rendering an input signal comprising a compressed HOA signal to obtain loudspeaker signals, wherein a HOA rendering matrix according to a given loudspeaker configuration is computed and used, comprises for each frame demultiplexing the input signal into a perceptually coded portion and a side information portion, and perceptually decoding in a perceptual decoder the perceptually coded portion, wherein perceptually decoded signals are obtained that represent two or more components of at least two different types that require a linear operation for reconstructing HOA coefficient sequences, wherein no HOA coefficient sequences are reconstructed, and wherein for components of a first type a fading of individual coefficient sequences is not required for said reconstructing, and for components of a second type a fading of individual coefficient sequences is required for said reconstructing. The method further comprises decoding in a side information decoder the side information portion, wherein decoded side information is obtained, applying linear operations that are individual for each frame, to components of the first type to generate first loudspeaker signals, and determining, according to the side information and individually for each frame, for each component of the second type three different linear operations. Among these, a linear operation is for coefficient sequences that according to the side information require no fading, a linear operation is for coefficient sequences that according to the side information require fading-in, and a linear operation is for coefficient sequences that according to the side information require fading-out.

The method further comprises generating from the perceptually decoded signals belonging to each component of the second type three versions, wherein a first version comprises the original signals of the respective component, which are not faded, a second version of signals is obtained by fading-in the original signals of the respective component, and a third version of signals is obtained by fading out the original signals of the respective component. Finally, the method comprises applying to each of said first, second and third versions of said perceptually decoded signals the respective linear operation and superimposing the results to generate second loudspeaker signals, and adding the first and second loudspeaker signals, wherein the loudspeaker signals of the decoded input signal are obtained.

An apparatus that utilizes the method is disclosed in claim 6. Another apparatus that utilizes the method is disclosed in claim 7.

In one embodiment, an apparatus for frame-wise combined decoding and rendering an input signal that comprises a compressed HOA signal comprises at least one hardware component, such as a hardware processor, and a non-transitory, tangible, computer-readable, storage medium (e.g. memory) tangibly embodying at least one software component that, when executed on the at least one hardware processor, causes the apparatus to perform the method disclosed herein.

In one embodiment, the invention relates to a computer readable medium having executable instructions to cause a computer to perform a method comprising steps of the method described herein.

Advantageous embodiments of the invention are disclosed in the dependent claims, the following description and the figures.

BRIEF DESCRIPTION OF THE DRAWINGS

Exemplary embodiments of the invention are described with reference to the accompanying drawings, which show in FIG. 1 *a*) a perceptual and side information source decoder.

DETAILED DESCRIPTION OF PREFERRED EMBODIMENTS

In the following, both the HOA decompression and rendering unit as described in [1, Ch.12] are briefly recapitulated, in order to explain modifications of the present principles for combining both processing units to reduce the computational demand.

1. Notation

For the HOA decompression and HOA rendering the signals are reconstructed frame-wise. Throughout this document, a multi-signal frame consisting e.g. of O signals and L samples is symbolized by a capital bold face letter with the frame index k following in brackets, like e.g. $C(k)\in\mathbb{R}^{O\times L}$. The same letter, however in small and bold face type, with a subscript integer index i (i.e. $c_i(k)\in\mathbb{R}^{1\times L}$) indicates the frame of the i-th signal within the multi-signal frame. Thus, the multi-signal frame C(k) can be expressed in terms of the single signal frames by $$C(k)=[(c_1(k))^T(c_2(k))^T \ldots (c_O(k))^T]^T \tag{1}$$

where (•)T denotes the transposition of a matrix. The l-th sample of a single signal frame $c_i(k)$ is represented by the same small letter, however in non-bold face type, followed by the frame and sample index in brackets, both separated by a comma, like e.g. $c_i(k,l)$. Hence, $c_i(k)$ can be written in terms of its samples as $$c_i(k)=[c_i(k,1)c_i(k,2) \ldots c_i(k,L)] \tag{2}$$

2. HOA Decompressor

Figure 1:
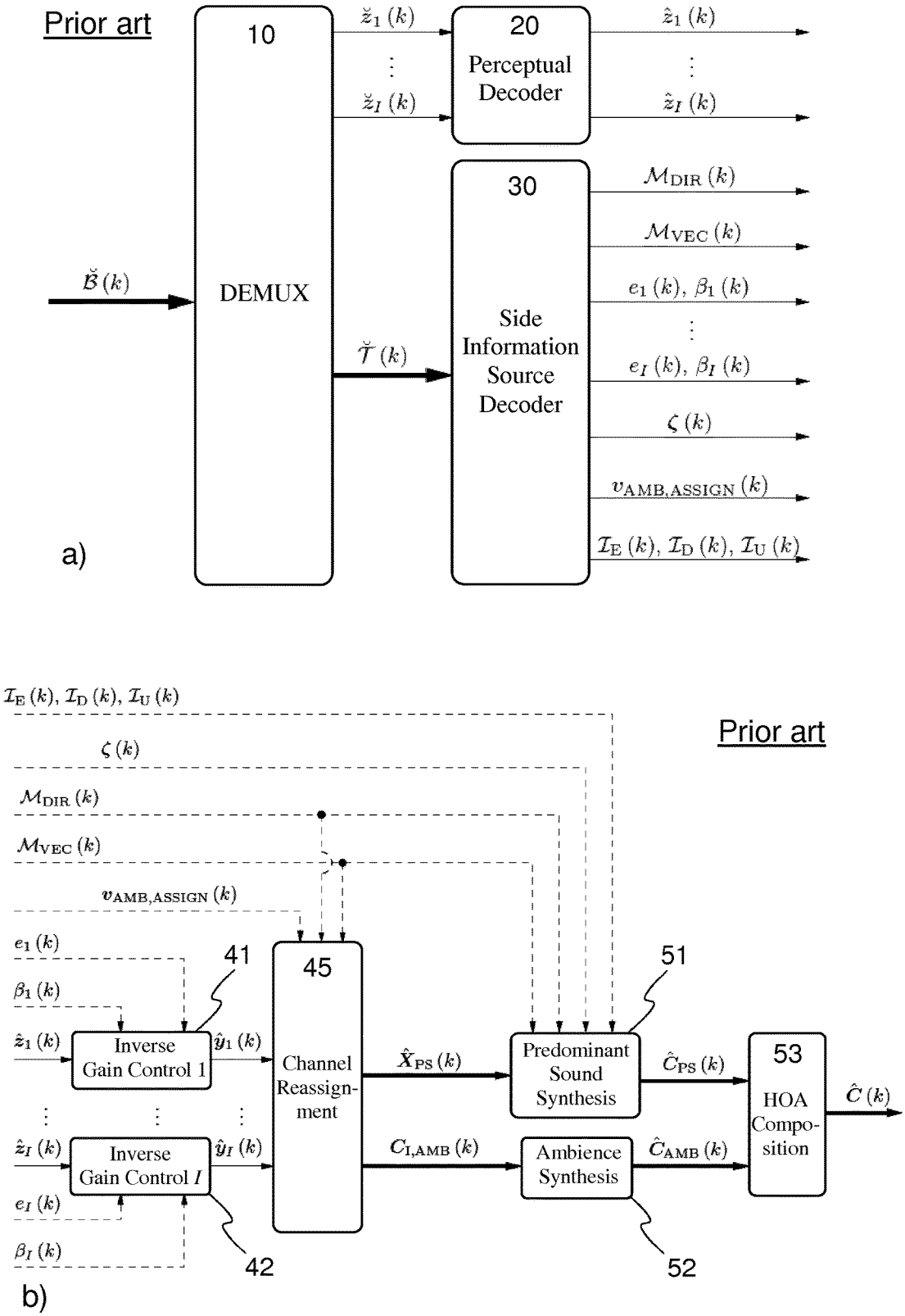
FIG. 1 *b*) a spatial HOA decoder.

The overall architecture of the HOA decompressor proposed in [1, Ch.12] is shown in FIG. 1. It can be subdivided into a perceptual and source decoding part depicted in FIG. 1*a*), followed by a spatial HOA decoding part depicted in FIG. 1*b*). The perceptual and source decoding part comprises a demultiplexer 10, a perceptual decoder 20 and a side information source decoder 30. The spatial HOA decoding part comprises a plurality of Inverse Gain Control blocks 41,42, one for each channel, a Channel Reassignment module 45, a Predominant Sound Synthesis module 51, an Ambience Synthesis module 52 and a HOA Composition module 53.

In the perceptual and side info source decoder, the k-th frame of the bit stream, $\breve{\mathcal{B}}(k)$, is first de-multiplexed 10 into the perceptually coded representation of the I signals, $\breve{\mathbf{z}}_1(k), \ldots, \breve{\mathbf{z}}_I(k)$, and into the frame $\breve{\mathcal{J}}(k)$ of the coded side information describing how to create an HOA representation thereof. Successively, a perceptual decoding 20 of the I signals and a decoding 30 of the side information is performed. Then, the spatial HOA decoder of FIG. 1 *b*) creates the frame $\hat{C}(k-1)$ of the reconstructed HOA representation from the decoded I signals, $\hat{z}_1(k), \ldots, \hat{z}_I(k)$, and the decoded side information.

2.1 Spatial HOA Decoder

In the spatial HOA decoder, each of the perceptually decoded signal frames $\hat{z}_i(k)$, $i\in\{1, \ldots, I\}$, is first input to an Inverse Gain Control processing block 41,42 together with the associated gain correction exponent $e_i(k)$ and gain correction exception flag $\beta_i(k)$. The i-th Inverse Gain Control processing provides a gain corrected signal frame $\hat{y}_i(k)$, $i\in\{1, \ldots, I\}$.

All of the I gain corrected signal frames $\hat{y}_i(k)$, $i\in\{1, \ldots, I\}$, are passed together with the assignment vector $v_{AMB,ASSIGN}(k)$ and the tuple sets $\mathcal{M}_{DIR}(k)$ and $\mathcal{M}_{VEC}(k)$ to the Channel Reassignment processing block 45, where they are redistributed to create the frame $\hat{X}_{PS}(k)$ of all predominant sound signals (i.e. all directional and vector based signals) and the frame $C_{I,AMB}(k)$ of an intermediate representation of the ambient HOA component. The meaning of the input parameters to the Channel Reassignment processing block is as follows. The assignment vector $v_{AMB,ASSIGN}(k)$ indicates for each transmission channel the index of a possibly contained coefficient sequence of the ambient HOA component. The tuple set $$\mathcal{M}_{DIR}(k) := \left\{ \begin{array}{l} (i, \Omega_{QUANT,i}(k)) \mid i \text{ is an index of an active} \\ \text{direction for the } (k+1)\text{-}th \text{ and } k\text{-}th \text{ frame} \end{array} \right\} \quad (3)$$

consists of tuples of which the first element i denotes the index of an active direction and of which the second element $\Omega_{QUANT,i}(k)$ denotes the respective quantized direction. In other words, the first element of the tuple indicates the index i of the gain corrected signal frame $\hat{y}_i(k)$ that is supposed to represent the directional signal related to the quantized direction $\Omega_{QUANT,i}(k)$ given by the second element of the tuple. Directions are always computed with respect to two successive frames. Due to overlap add processing, there occurs the special case that for the last frame of the activity period for a directional signal there is actually no direction, which is signalized by setting the respective quantized direction to zero.

The tuple set $$\mathcal{M}_{VEC}(k) := \left\{ \begin{array}{l} (i, v^{(i)}(k)) \mid i \text{ is an index of a vector found} \\ \text{for the } (k+1)\text{-}th \text{ and } k\text{-}th \text{ frame} \end{array} \right\} \quad (4)$$

consists of tuples of which the first element i indicates the index of the gain corrected signal frame that represents the signal to be reconstructed by the vector $v^{(i)}(k)$, which is given by the second element of the tuple. The vector $v^{(i)}(k)$ represents information about the spatial distributions (directions, widths, shapes) of the active signal in the reconstructed HOA frame $\hat{C}(k)$. It is assumed that $v^{(i)}(k)$ has an Euclidean norm of N+1.

In the Predominant Sound Synthesis processing block 51, the frame $\hat{C}_{PS}(k)$ of the HOA representation of the predominant sound component is computed from the frame $\hat{X}_{PS}(k)$ of all predominant sound signals. It uses the tuple sets $\mathcal{M}_{DIR}(k)$ and $\mathcal{M}_{VEC}(k)$, the set $\zeta(k)$ of prediction parameters and the sets $\mathcal{I}_E(k)$, $\mathcal{I}_D(k)$, and $\mathcal{I}_U(k)$ of coefficient indices of the ambient HOA component, which have to be enabled, disabled and to remain active in the k-th frame.

In the Ambience Synthesis processing block 52, the ambient HOA component frame $\hat{C}_{AMB}(k)$ is created from the frame $C_{I,AMB}(k)$ of the intermediate representation of the ambient HOA component. This processing also comprises an inverse spatial transform to invert the spatial transform applied in the encoder for decorrelating the first $O_{MIN}$ coefficients of the ambient HOA component.

Finally, in the HOA Composition processing block 53 the ambient HOA component frame $\hat{C}_{mu}(k)$ and the frame $\hat{C}_{PS}(k)$ of the predominant sound HOA component are superposed to provide the decoded HOA frame $\hat{C}(k)$.

In the following, the Channel Reassignment block 45, the Predominant Sound Synthesis block 45, the Ambience Synthesis block 52 and the HOA Composition processing block 51 are described in detail, since these blocks will be combined with the HOA renderer to reduce the computational demand.

2.1.1 Channel Reassignment

The Channel Reassignment processing block 45 has the purpose to create the frame $\hat{X}_{PS}(k)$ of all predominant sound signals and the frame $C_{I,AMB}(k)$ of an intermediate representation of the ambient HOA component from the gain corrected signal frames $\hat{y}_i(k)$, $i \in \{1, \ldots, I\}$, and the assignment vector $v_{AMB,ASSIGN}(k)$, which indicates for each transmission channel the index of a possibly contained coefficient sequence of the ambient HOA component.

Additionally, the sets $\mathcal{I}_{DIR}(k)$ and $\mathcal{I}_{VEC}(k)$ are used, which contain the first elements of all tuples of $\mathcal{M}_{DIR}(k)$ and $\mathcal{M}_{VEC}(k)$, respectively. It is important to note that these two sets are disjoint.

For the actual assignment, the following steps are performed.

1. The sample values of the frame $\hat{X}_{PS}(k)$ of all predominant sound signals are computed as follows:

$$\hat{x}_{PS,i}(k, l) = \begin{cases} \hat{y}_i(k, l) & \text{if } i \in \mathcal{I}_{DIR}(k) \cup \mathcal{I}_{VEC}(k) \\ 0 & \text{else} \end{cases} \quad (5)$$

$$\text{for } i = 1, \ldots, J, l = 1, \ldots, L,$$

where $J = I - O_{MIN}$.

2. The sample values of the frame $C_{I,AMB}(k)$ of the intermediate representation of the ambient HOA component are obtained as follows:

$$c_{I,AMB,n}(k, l) = \begin{cases} \hat{y}_i(k, l) & \text{if } \exists\, i \in \{1, \ldots, I\} \text{ such that } v_{AMB,ASSIGN,i}(k) = n \\ 0 & \text{else} \end{cases} \quad (6)$$

(Note: "∃" means "it exists")

2.1.2 Ambience Synthesis

The first $O_{MIN}$ coefficients of the frame $\hat{C}_{AMB}(k)$ of the ambient HOA component are obtained by $$\begin{bmatrix} \hat{c}_{AMB,1}(k) \\ \hat{c}_{AMB,2}(k) \\ \vdots \\ \hat{c}_{AMB,O_{MIN}}(k) \end{bmatrix} = \Psi^{(N_{MIN},N_{MIN})} \cdot \begin{bmatrix} c_{I,AMB,1}(k) \\ c_{I,AMB,2}(k) \\ \vdots \\ c_{I,AMB,O_{MIN}}(k) \end{bmatrix} \quad (7)$$

where $\Psi^{(N_{MIN},N_{MIN})} \in \mathbb{R}^{O_{MIN} \times O_{MIN}}$ denotes the mode matrix of order $N_{MIN}$ defined in [1, Annex F.1.5]. The sample values of the remaining coefficients of the ambient HOA component are set according to $$\hat{c}_{AMB,n}(k,l) = c_{I,AMB,n}(k,l) \text{ for } O_{MIN} < n \leq O \quad (8)$$

2.1.3 Predominant Sound Synthesis

Figure 2:
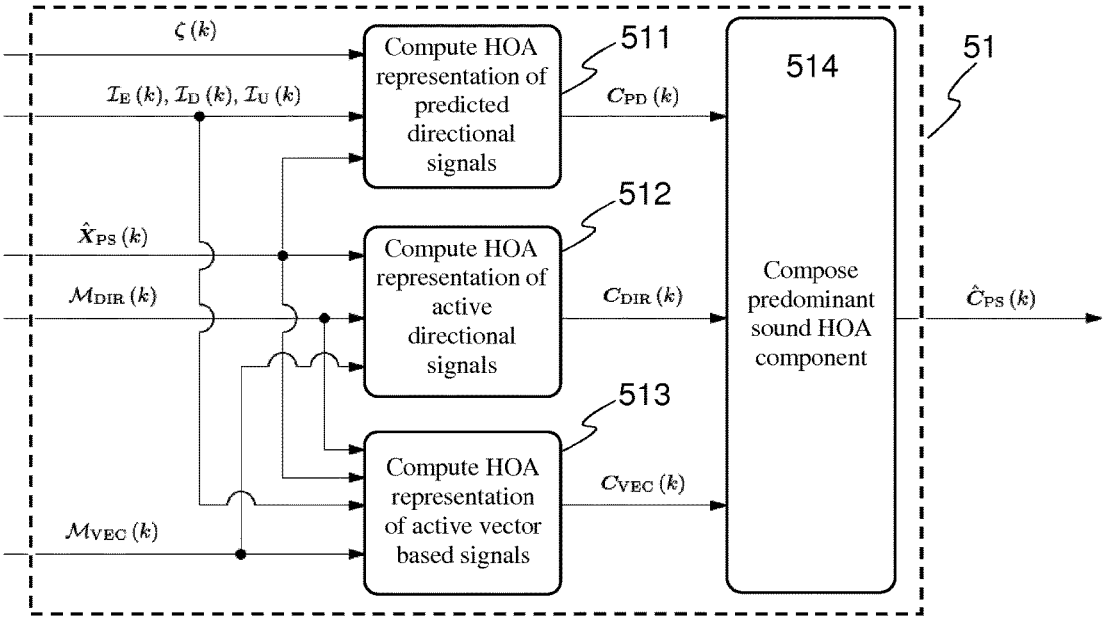
FIG. 2 the predominant sound synthesis module.

The Predominant Sound Synthesis 51 has the purpose to create the frame $\hat{C}_{PS}(k)$ of the HOA representation of the predominant sound component from the frame $\hat{X}_{PS}(k)$ of all predominant sound signals using the tuple sets $\mathcal{M}_{DIR}(k)$ and $\mathcal{M}_{VEC}(k)$, the set $\zeta(k)$ of prediction parameters, and the sets $\mathcal{I}_E(k)$, $\mathcal{I}_D(k)$ and $\mathcal{I}_U(k)$. The processing can be subdivided into four processing steps, namely computing a HOA representation of active directional signals, computing a HOA representation of predicted directional signals, computing a HOA representation of active vector based signals and composing a predominant sound HOA component. As illustrated in FIG. 2, the Predominant Sound Synthesis block 51 can be subdivided into four processing blocks, namely a block 511 for computing a HOA representation of predicted directional signals, a block 512 for computing a HOA representation of active directional signals, a block 513 for computing a HOA representation of active vector based signals, and a block 514 for composing a predominant sound HOA component. These are described in the following.

2.1.3.1 Compute HOA Representation of Active Directional Signals

In order to avoid artifacts due to changes of the directions between successive frames, the computation of the HOA representation from the directional signals is based on the concept of overlap add.

Hence, the HOA representation $C_{DIR}(k)$ of active directional signals is computed as the sum of a faded out component and a faded in component:

$$C_{DIR}(k)=C_{DIR,OUT}(k)+C_{DIR,IN}(k) \tag{9}$$

To compute the two individual components, in a first step the instantaneous signal frames for directional signal indices $d\in\mathcal{I}_{DIR}(k_1)$ and directional signal frame index $k_2$ are defined by $$C_{DIR,I}^{(d)}(k_1,k_2):=\Psi^{(N,29)}|_{\Omega_{QUANT,d}(k_1)}\hat{x}_{PS,d}(k_2) \tag{10}$$

where $\Psi^{(N,29)}\in\mathbb{R}^{O\times 900}$ denotes the mode matrix of order N with respect to the directions $\Omega_2^{(29)}$, n=1, . . . , 900, defined in [1, Annex F.1.5] and $\Psi^{(N,29)}|_q$ denotes the q-th column vector of $\Psi^{(N,29)}$.

The sample values of the faded out and faded in directional HOA components are then determined by $$c_{DIR,OUT,i}(k,l)=\sum_{d\in\mathcal{I}_{DIR,NZ}(k-1)} c_{DIR,l,i}^{(d)}(k-1;k,l)\cdot \begin{cases} w_{DIR}(L+l) & \text{if } d\in\mathcal{I}_{DIR,NZ}(k) \\ w_{VEC}(L+l) & \text{if } d\in\mathcal{I}_{VEC}(k) \\ 1 & \text{else} \end{cases} \tag{11}$$

and $$c_{DIR,IN,i}(k,l)=\sum_{d\in\mathcal{I}_{DIR,NZ}(k)} c_{DIR,l,i}^{(d)}(k;k,l)\cdot \begin{cases} w_{DIR}(l) & \text{if } d\in\mathcal{I}_{DIR}(k-1)\cup\mathcal{I}_{VEC}(k-1) \\ 1 & \text{else} \end{cases} \tag{12}$$

where $\mathcal{I}_{DIR,NZ}(k)$ denotes the set of those first elements of $\mathcal{M}_{DIR}(k)$ where the corresponding second element is non-zero.

The fading of the instantaneous HOA representations for the overlap add operation is accomplished with two different fading windows $$w_{DIR}:=[w_{DIR}(1)w_{DIR}(2)\ldots w_{DIR}(2L)] \tag{13}$$

$$w_{VEC}:=[w_{VEC}(1)w_{VEC}(2)\ldots w_{VEC}(2L)] \tag{14}$$

whose elements are defined in [1, Sec. 12.4.2.4.2].

2.1.3.2 Compute HOA Representation of Predicted Directional Signals

The parameter set $\zeta(k)=\{p_{TYPE}(k), P_{IND}(k), P_{Q,F}(k)\}$ related to the spatial prediction consists of the vector $p_{TYPE}(k)\in\mathbb{N}^O$ and the matrices $P_{IND}(k)\in\mathbb{N}^{D_{PRED}\times O}$ and $P_{Q,F}(k)\in\mathbb{N}^{D_{PRED}\times O}$, which are defined in [1, Sec. 12.4.2.4.3]. Additionally, the following dependent quantity $$b_{ACT}(k)=\begin{cases} 1 & \text{if } \exists\, n \text{ such that } p_{TYPE,n}(k)=0 \\ 0 & \text{else} \end{cases} \tag{15}$$

is introduced, which indicates whether a prediction is to be performed related to frames k and (k+1). Further, the quantized prediction factors $p_{Q,F,d,n}(k)$, d=1, . . . , $D_{PRED}$, n=1, . . . , O, are dequantized to provide the actual prediction factors $$p_{F,d,n}(k)=(p_{Q,F,d,n}(k)+1/2)\cdot 2^{-B_{SC}+1} \tag{16}$$

(Note: $B_{SC}$ is defined in [1]. In principle, it is the number of bits used for quantization.)

The computation of the predicted directional signals is based on the concept of overlap add in order to avoid artifacts due to changes of the prediction parameters between successive frames. Hence, the k-th frame of the predicted directional signals, denoted by $X_{PD}(k)$, is computed as the sum of a faded out component and a faded in component:

$$X_{PD}(k)=X_{PD,OUT}(k)+X_{PD,IN}(k) \tag{17}$$

The sample values $x_{PD,OUT}(k,l)$ and $x_{PD,IN,n}(k,l)$, n=1, . . . , O, l=1, . . . , L, of the faded out and faded in predicted directional signals are then computed by $$x_{PD,OUT,n}(k,l)=w_{DIR}(L+l)\cdot \begin{cases} 0 & \text{if } p_{TYPE,n}(k-1)=0 \\ \sum_{d=1}^{D_{PRED}} p_{F,d,n}(k-1)\cdot\hat{x}_{PS,p_{IND,d,n}(k-1)}(k,l) & \text{if } p_{TYPE,n}(k-1)=1 \end{cases} \tag{18}$$

$$x_{PD,IN,n}(k,l)= w_{DIR}(l)\cdot \begin{cases} 0 & \text{if } p_{TYPE,n}(k)=0 \\ \sum_{d=1}^{D_{PRED}} p_{F,d,n}(k)\cdot\hat{x}_{PS,p_{IND,d,n}(k)}(k,l) & \text{if } p_{TYPE,n}(k)=1 \end{cases} \tag{19}$$

In a next step, the predicted directional signals are transformed to the HOA domain by $$C_{PD,I}(k)=\Psi^{(N,N)}\cdot X_{PD}(k) \tag{20}$$

where $\Psi^{(N,N)}\in\mathbb{R}^{O\times O}$ denotes the mode matrix of order N defined in [1, Annex F.1.5]. The samples of the final output HOA representation $C_{PD}(k)$ of the predicted directional signals are computed by $$c_{PD,n}(k,l)= \begin{cases} 0 & \text{if } n\in\mathcal{I}_U(k) \\ c_{PD,I,n}(k,l)\cdot w_{DIR}(l) & \text{if } n\in\mathcal{I}_D(k)\wedge b_{ACT}(k-1)=1 \\ c_{PD,I,n}(k,l)\cdot w_{DIR}(L+l) & \text{if } n\in\mathcal{I}_E(k)\wedge b_{ACT}(k)=1 \\ c_{PD,I,n}(k,l) & \text{else} \end{cases} \tag{21}$$

for $n=1,\ldots,O$, $l=1,\ldots,L$.

2.1.3.3 Compute HOA Representation of Active Vector Based Signals

The computation of the HOA representation of the vector based signals is here described in a different notation, compared to the version in [1, Sec.12.4.2.4.4], in order to keep the notation consistent with the rest of the description.

Nevertheless, the operations described here are exactly the same as in [1].

The frame $\tilde{C}_{VEC}(k)$ of the preliminary HOA representation of active vector based signals is computed as the sum of a faded out component and a faded in component:

$$\tilde{C}_{VEC}(k)=\tilde{C}_{VEC,OUT}(k)+\tilde{C}_{VEC,IN}(k) \tag{22}$$

To compute the two individual components, in a first step the instantaneous signal frames for vector based signal indices $d \in \mathcal{J}_{VEC}(k_1)$ and vector based signal frame index $k_2$ are defined by $$c_{VEC,I}^{(d)}(k_1;k_2) := v^{(d)}(k_1)\hat{x}_{PS,d}(k_2) \tag{23}$$

The sample values of the faded out and faded in vector based HOA components $\tilde{C}_{VEC,OUT}(k)$ and $\tilde{C}_{VEC,IN}(k)$ are then determined by $$\tilde{c}_{VEC,OUT,i}(k,l) = \sum_{d \in \mathcal{J}_{VEC}(k-1)} c_{VEC,I,i}^{(d)}(k-1;k,l) \cdot \begin{cases} w_{DIR}(L+l) & \text{if } d \in \mathcal{J}_{DIR}(k) \\ w_{VEC}(L+l) & \text{if } d \in \mathcal{J}_{VEC}(k) \\ 0 & \text{else} \end{cases} \tag{24}$$

$$\tilde{c}_{VEC,IN,i}(k,l) = \sum_{d \in \mathcal{J}_{VEC}(k)} c_{VEC,I,i}^{(d)}(k;k,l) \cdot \begin{cases} w_{VEC}(l) & \text{if } d \in \mathcal{J}_{DIR}(k-1) \cup \mathcal{J}_{VEC}(k-1) \\ 1 & \text{else} \end{cases} \tag{25}$$

Thereafter, the frame $C_{VEC}(k)$ of the final HOA representation of active vector based signals is computed by $$c_{VEC,n}(k,l) = \begin{cases} \tilde{c}_{VEC,n}(k,l) \cdot w_{DIR}(l) & \text{if } n \in \mathcal{J}_D(k) \wedge E = 1 \\ \tilde{c}_{VEC,n}(k,l) \cdot w_{DIR}(L+l) & \text{if } n \in \mathcal{J}_E(k) \wedge E = 1 \\ \tilde{c}_{VEC,n}(k,l) & \text{else} \end{cases} \tag{26}$$

for n=1, . . . , O, l=1, . . . , L, where E=CodedVVecLength is defined in [1, Sec. 12.4.1.10.2].

2.1.3.4 Compose Predominant Sound HOA Component

The frame $\hat{C}_{PS}(k)$ of the predominant sound HOA component is obtained 514 as the sum of the frame $C_{DIR}(k)$ of the HOA component of the directional signals, the frame $C_{PD}(k)$ of the HOA component of the predicted directional signals and the frame $C_{VEC}(k)$ of the HOA component of the vector based signals and, i.e.

$$\hat{C}_{PS}(k) = C_{DIR}(k) + C_{PD}(k) + C_{VEC}(k) \tag{27}$$

2.1.4 HOA Composition

The decoded HOA frame $\hat{C}(k)$ is computed in a HOA composition block 53 by $$\hat{C}(k) = \hat{C}_{AMB}(k) + \hat{C}_{PS}(k) \tag{28}$$

3. HOA Renderer

The HOA renderer (see [1, Sec. 12.4.3]) computes the frame $\hat{W}(k) \in \mathbb{R}^{L_S \times L}$, of $L_S$ loudspeaker signals from the frame $\hat{C}(k)$ of the reconstructed HOA representation, which is provided by the spatial HOA decoder (see Sec.2.1 above). Note that FIG. 1 does not explicitly show the renderer. Generally, the computation for HOA rendering is accomplished by the multiplication with the rendering matrix $D \in \mathbb{R}^{L_S \times O}$ according to $$\hat{W}(k) = D \cdot \hat{C}(k) \tag{29}$$

where the rendering matrix is computed in an initialization phase depending on the target loudspeaker setup, as described in [1, Sec.12.4.3.3].

Figure 3:
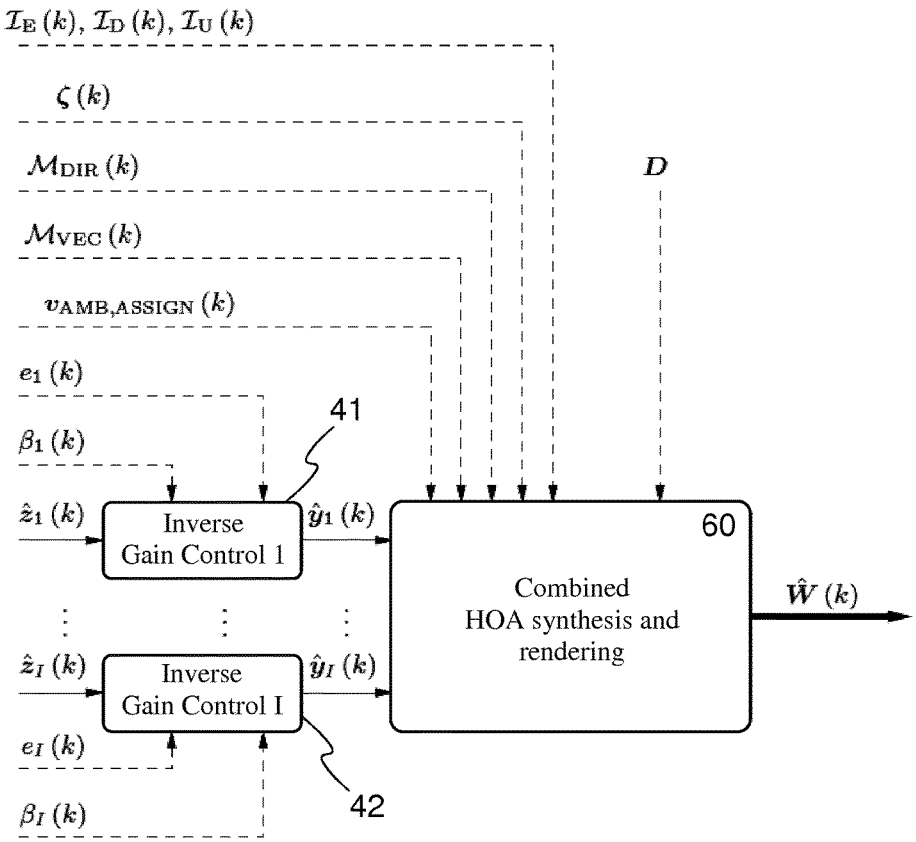
FIG. 3 a combined spatial HOA decoder and renderer.

The present invention discloses a solution for a considerable reduction of the computational demand for the spatial HOA decoder (see Sec.2.1 above) and the subsequent HOA renderer (see Sec.3 above) by combining these two processing modules, as illustrated in FIG. 3. This allows to directly output frames $\hat{W}(k)$ of loudspeaker signals instead of reconstructed HOA coefficient sequences. In particular, the original Channel Reassignment block 45, the Predominant Sound Synthesis block 51, the Ambience Synthesis block 52, the HOA composition block 53 and the HOA renderer are replaced by the combined HOA synthesis and rendering processing block 60.

This newly introduced processing block requires additional knowledge of the rendering matrix D, which is assumed to be precomputed according to [1, Sec. 12.4.3.3], like in the original realization of the HOA renderer.

3.1 Overview of Combined HOA Synthesis and Rendering

Figure 4:
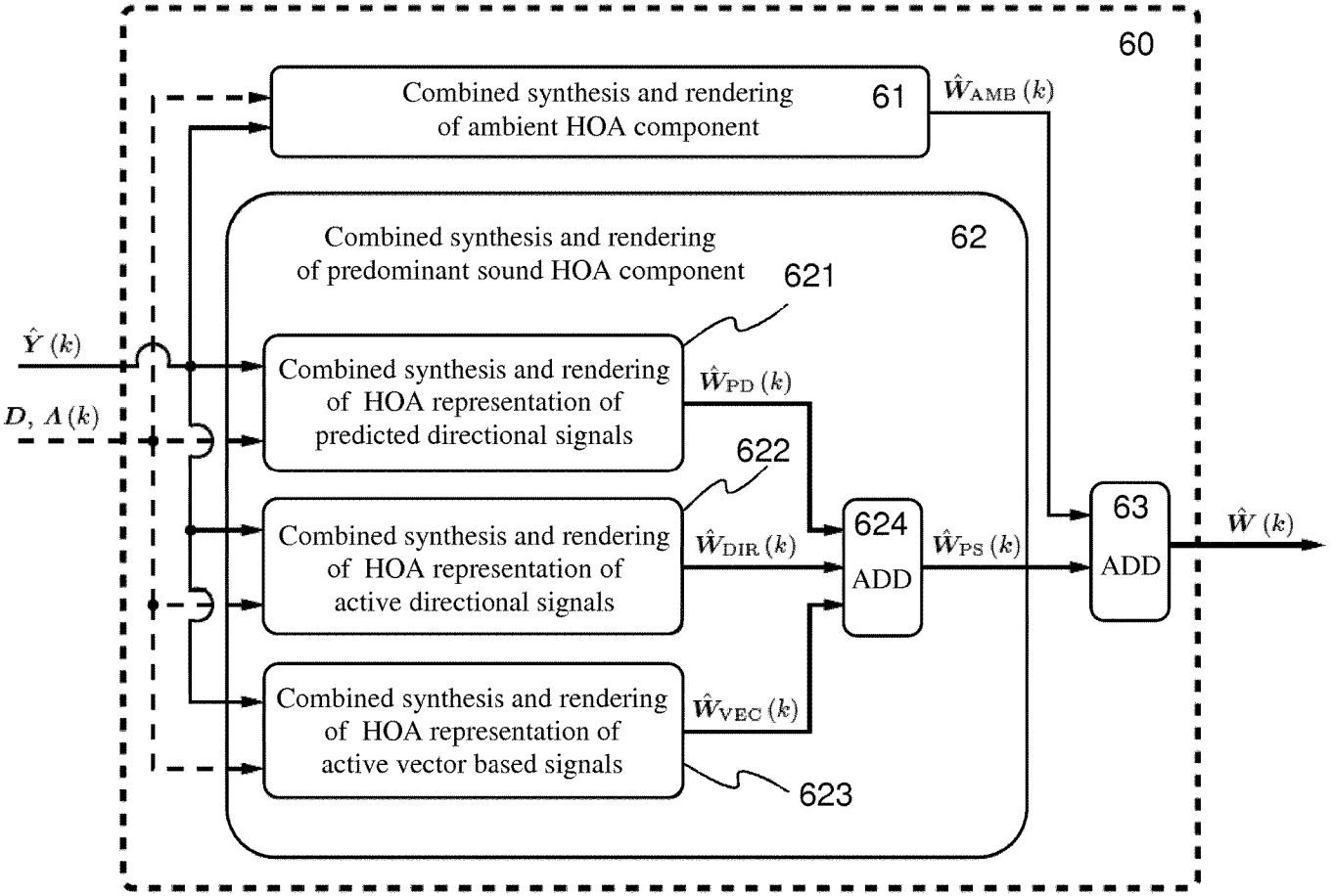
FIG. 4 details of the combined spatial HOA decoder and renderer.

In one embodiment, a combined HOA synthesis and rendering is illustrated in FIG. 4. It directly computes the decoded frame $\hat{W}(k) \in \mathbb{R}^{L_S \times L}$ of loudspeaker signals from the frame $\hat{Y}(k) \in \mathbb{R}^{I \times L}$ of gain corrected signals, the rendering matrix $D \in \mathbb{R}^{L_S \times O}$ and a sub-set $\Lambda(k)$ of the side information defined by $$\Lambda(k) := \{\mathcal{J}_E(k), \mathcal{J}_D(k), \mathcal{J}_U(k), \xi(k), \mathcal{M}_{DIR}(k), \mathcal{M}_{VEC}(k), v_{AMB,ASSIGN}(k)\} \tag{30}$$

As can be seen from FIG. 4, the processing can be subdivided into the combined synthesis and rendering of the ambient HOA component 61 and the combined synthesis and rendering of the predominant sound HOA component 62, of which the outputs are finally added. Both processing blocks are described in detail in the following.

3.1.1 Combined Synthesis and Rendering of Ambient HOA Component

A general idea for the proposed computation of the frame $\hat{W}_{AMB}(k)$ of the loudspeaker signals corresponding to the ambient HOA component is to omit the intermediate explicit computation of the corresponding HOA representation $C_{AMB}(k)$, other than proposed in [1, App. G.3]. In particular, for the first $O_{MIN}$ spatially transformed coefficient sequences, which are always transmitted within the last $O_{MIN}$ transport signals $\hat{y}_i(k)$, $i=I-O_{MIN}+1, \ldots, I$, the inverse spatial transform is combined with the rendering.

A second aspect is that, similar to what is already suggested in [1, App. G.3], the rendering is performed only for those coefficient sequences, which have been actually transmitted within the transport signals, thereby omitting any meaningless rendering of zero coefficient sequences.

Altogether, the computation of the frame $\hat{W}_{AMB}(k)$ is expressed by a single matrix multiplication according to $$\hat{W}_{AMB}(k) = A_{AMB}(k) \cdot Y_{AMB}(k) \tag{31}$$

where the computation of the matrices $A_{AMB}(k) \in \mathbb{R}^{L_S \times Q_{AMB}(k)}$ and $Y_{AMB}(k) \in \mathbb{R}^{Q_{AMB}(k) \times L}$ is explained in the following. The number $Q_{AMB}(k)$ of columns of $A_{AMB}(k)$ or rows of $Y_{AMB}(k)$ corresponds to the number of elements of $$\mathcal{J}_{AMB}(k) := \mathcal{J}_E(k) \cup \mathcal{J}_D(k) \cup \mathcal{J}_U(k) \tag{32}$$

being the union of the sets $\mathcal{J}_E(k)$, $\mathcal{J}_D(k)$ and $\mathcal{J}_U(k)$. Differently expressed, the number $Q_{AMB}(k)$ is the number of totally transmitted ambient HOA coefficient sequences or their spatially transformed versions.

The matrix $A_{AMB}(k)$ consists of two components, $A_{AMB,MIN} \in \mathbb{R}^{L_S \times O_{MIN}}$ and $A_{AMB,REST}(k)$, as $$A_{AMB}(k) = [A_{AMB,MIN} A_{AMS,REST}(k)] \tag{33}$$

The first component $A_{AMB,MIN}$ is computed by $$A_{AMB,MIN} = D_{MIN} \Psi^{(N_{MIN},N_{MIN})} \tag{34}$$

where $D_{MIN} \in \mathbb{R}^{L_S \times O_{MIN}}$ denotes the matrix resulting from the first $O_{MIN}$ columns of D. It accomplishes the actual combination of the inverse spatial transform for the first $O_{MIN}$ spatially transformed coefficient sequences of the ambient HOA component, which are always transmitted within the last $O_{MIN}$ transport signals, with the corresponding rendering. Note that this matrix ($A_{AMB,MIN}$ and likewise $D_{MIN}$) is frame independent and can be precomputed during an initialization process.

The remaining matrix $A_{AMB,REST}(k)$ accomplishes the rendering of those HOA coefficient sequences of the ambient HOA component that are transmitted within the transport signals additionally to the always transmitted first $O_{MIN}$ spatially transformed coefficient sequences. Hence, this matrix consists of columns of the original rendering matrix D corresponding to these additionally transmitted HOA coefficient sequences. The order of the columns is arbitrary in principle, however, must match with the order of the corresponding coefficient sequences assigned to the signal matrix $Y_{AMB}(k)$. In particular, if we assume any ordering being defined by the following bijective function $$f_{AMB,ORD,k}: \mathcal{J}_{AMB}(k)\setminus\{1,O_{MIN}\} \rightarrow 1,\ldots,Q_{AMB}(k)-O_{MIN} \tag{35}$$

the j-th column of $A_{AMB,REST}(k)$ is set to the $(f_{AMB,ORD,k}^{-1}(j))$-th column of the rendering matrix D.

Correspondingly, the individual signal frames $y_{AMB,i}(k)$, $i=1,\ldots,Q_{AMB}(k)$ within the signal matrix $Y_{AMB}(k)$ have to be extracted from the frame Y(k) of gain corrected signals by $$y_{AMB,j}(k) = \begin{cases} \hat{y}_{l-O_{MIN}+j}(k) & \text{if } 1 \le j \le O_{MIN} \\ \hat{y}_i(k) \text{ s.t. } v_{A,i}(k) = f_{AMB,ORD,k}^{-1}(j-O_{MIN}) & \text{if } O_{MIN} < j \le Q_{AMB}(k) \end{cases} \tag{36}$$

3.1.2 Combined Synthesis and Rendering of Predominant Sound HOA Component

As shown in FIG. 4, the combined synthesis and rendering of the predominant sound HOA component itself can be subdivided into three parallel processing blocks 621-623, of which the loudspeaker signal output frames $\hat{W}_{PD}(k)$, $\hat{W}_{DIR}(k)$ and $\hat{W}_{VEC}(k)$ are finally added 624,63 to obtain the frame $\hat{W}_{PS}(k)$ of the loudspeaker signals corresponding to the predominant sound HOA component. A general idea for the computation of all three blocks is to reduce the computational demand by omitting the intermediate explicit computation of the corresponding HOA representation. All of the three processing blocks are described in detail in the following.

3.1.2.1 Combined Synthesis and Rendering of HOA Representation of Predicted Directional Signals 621

The combined synthesis and rendering of HOA representation of predicted directional signals 621 was regarded impossible in [1, App. G.3], which was the reason to exclude from [1] the option of spatial prediction in the case of an efficient combined spatial HOA decoding and rendering. The present invention, however, discloses also a method to realize an efficient combined synthesis and rendering of the HOA representation of spatially predicted directional signals. The original known idea of the spatial prediction is to create O virtual loudspeaker signals, each from a weighted sum of active directional signals, and then to create an HOA representation thereof by using the inverse spatial transform. However, the same process, viewed from a different perspective, can be seen as defining for each active directional signal, which participates in the spatial prediction, a vector defining its directional distribution, similar as for the vector based signals used in Sec.2.1 above. Combining the rendering with the HOA synthesis can then be expressed by means of multiplying the frame of all active directional signals involved in the spatial prediction with a matrix which describes their panning to the loudspeaker signals. This operation reduces the number of signals to be processed from O to the number of active directional signals involved in the spatial prediction, and thereby makes the most computational demanding part of the HOA synthesis and rendering independent of the HOA order N.

Another important aspect to be addressed is the eventual fading of certain coefficient sequences of the HOA representation of spatially predicted signals (see eq.(21)). The proposed solution to solve that issue for the combined HOA synthesis and rendering is to introduce three different types of active directional signals, namely non-faded, faded out and faded in ones. For all signals of each type a special panning matrix is then computed by involving from the HOA rendering matrix and from the HOA representation only the coefficient sequences with the appropriate indices, namely indices of non-transmitted ambient HOA coefficient sequences contained in $$\mathcal{J}_{1A}(k) := \{1,\ldots,O\}\setminus(\mathcal{J}_E(k)\cup\mathcal{J}_D(k)\cup\mathcal{J}_U(k)) \tag{37}$$

and indices of faded out or faded in ambient HOA coefficient sequences contained in $\mathcal{J}_D(k)$ and $\mathcal{J}_E(k)$, respectively.

In detail, the computation of the frame $\hat{W}_{PD}(k)$ of the loudspeaker signals corresponding to the HOA representation of predicted directional signals is expressed by a single matrix multiplication according to $$\hat{W}_{PD}(k) = A_{PD}(k)\cdot Y_{PD}(k) \tag{38}$$

Both matrices, $A_{PD}(k)$ and $Y_{PD}(k)$, consist each of two components, i.e. one component for the faded out contribution from the last frame and one component for the faded in contribution from the current frame:

$$A_{PD}(k) = [A_{PD,OUT}(k) \quad A_{PD,IN}(k)] \tag{39}$$

$$Y_{PD}(k) = \begin{bmatrix} Y_{PD,OUT}(k) \\ Y_{PD,IN}(k) \end{bmatrix} \tag{40}$$

Each sub matrix itself is assumed to consist of three components as follows, related to the three previously mentioned types of active directional signals, namely non-faded, faded out and faded in ones:

$$A_{PD,OUT}(k) = [\,A_{PD,OUT,IA}(k) \quad A_{PD,OUT,E}(k) \quad A_{PD,OUT,D}(k)\,] \tag{41}$$

$$A_{PD,IN}(k) = [\,A_{PD,IN,IA}(k) \quad A_{PD,IN,E}(k) \quad A_{PD,IN,D}(k)\,] \tag{42}$$

$$Y_{PD,OUT}(k) = \begin{bmatrix} Y_{PD,OUT,IA}(k) \\ Y_{PD,OUT,E}(k) \\ Y_{PD,OUT,D}(k) \end{bmatrix} \tag{43}$$

$$Y_{PD,IN}(k) = \begin{bmatrix} Y_{PD,IN,IA}(k) \\ Y_{PD,IN,E}(k) \\ Y_{PD,IN,D}(k) \end{bmatrix} \tag{44}$$

Each sub-matrix component with label "IA", "E" and "D" is associated with the set $\mathcal{J}_{IA}(k)$, $\mathcal{J}_E(k)$, and $\mathcal{J}_D(k)$, and is assumed to be not existent in the case the corresponding set is empty.

To compute the individual sub-matrix components, we first introduce the set of indices of all active directional signals involved in the spatial prediction $$\mathcal{J}_{PD}(k)=\{p_{IND,d,n}(k)|d\in\{1,\ldots,D_{PRED}\},\ n\in\{1,\ldots,O\}\}\setminus\{0\} \quad (45)$$

of which the number of elements is denoted by $$Q_{PD}(k)=\|\mathcal{J}_{PD}(k)| \quad (46)$$

Further, the indices of the set $\mathcal{J}_{PD}(k)$ are ordered by the following bijective function $$f_{PD,ORD,k}:\mathcal{J}_{PD}(k)\rightarrow\{1,\ldots,Q_{PD}(k)\} \quad (47)$$

Then we define the matrix $A_{WEIGH}(k)\in\mathbb{R}^{O\times Q_{PD}(k)}$, of which the i-th column consists of O elements, where the n-th element defines the weighting of the mode vector with respect to the direction $\Omega_n^{(N)}$ in order to construct the vector representing the directional distribution of the active directional signal with index $f_{PD,ORD,k}^{-1}(i)$ Its elements are computed by $$a_{WEIGH,n,i}(k)=\begin{cases} p_{F,d,n}(k) & \text{if } \exists\, d\in\{1\ \ldots\ ,,D_{PRED}\}\text{ s.t. } p_{IND,d,n}(k)=f_{PD,ORD,k}^{-1}(i) \\ 0 & \text{else}\end{cases} \quad (48)$$

Using the matrix $A_{WEIGH}(k)$ we can compute the matrix $V_{PD}(k)\in\mathbb{R}^{O\times Q_{PD}(k)}$, of which the i-th column represents the directional distribution of the active directional signal with index $f_{PD,ORD,k}^{-1}(i)$, by $$V_{PD}(k)=\Psi^{(N,N)}\cdot A_{WEIGH}(k) \quad (49)$$

We further denote by $A^{\leftarrow\{\mathcal{J}\}}$ the matrix obtained by taking from a matrix A the rows with indices (in an ascending order) contained in the set $\mathcal{J}$. Similarly, we denote by $A^{\downarrow\{\mathcal{J}\}}$ the matrix obtained by taking from a matrix A the columns with indices (in an ascending order) contained in the set $\mathcal{J}$.

The components of the matrices $A_{PD,OUT}(k)$ and $A_{PD,IN}(k)$ in eq.(41) and (42) are finally obtained by multiplying appropriate sub-matrices of the rendering matrix D with appropriate sub-matrices of the matrix $V_{PD}(k-1)$ or $V_{PD}(k)$ representing the directional distribution of the active directional signals, i.e.

$$A_{PD,OUT,IA}(k)=\boldsymbol{D}^{\downarrow\{\mathcal{J}_{IA}(k)\}}\cdot V_{PD}(k-1)^{\leftarrow\{\mathcal{J}_{IA}(k)\}} \quad (50)$$

$$A_{PD,OUT,E}(k)=\boldsymbol{D}^{\downarrow\{\mathcal{J}_{E}(k)\}}\cdot V_{PD}(k-1)^{\leftarrow\{\mathcal{J}_{E}(k)\}} \quad (51)$$

$$A_{PD,OUT,D}(k)=\boldsymbol{D}^{\downarrow\{\mathcal{J}_{D}(k)\}}\cdot V_{PD}(k-1)^{\leftarrow\{\mathcal{J}_{D}(k)\}} \quad (52)$$

and $$A_{PD,IN,IA}(k)=\boldsymbol{D}^{\downarrow\{\mathcal{J}_{IA}(k)\}}\cdot V_{PD}(k)^{\leftarrow\{\mathcal{J}_{IA}(k)\}} \quad (53)$$

$$A_{PD,IN,E}(k)=\boldsymbol{D}^{\downarrow\{\mathcal{J}_{E}(k)\}}\cdot V_{PD}(k)^{\leftarrow\{\mathcal{J}_{E}(k)\}} \quad (54)$$

$$A_{PD,IN,D}(k)=\boldsymbol{D}^{\downarrow\{\mathcal{J}_{D}(k)\}}\cdot V_{PD}(k)^{\leftarrow\{\mathcal{J}_{I}(k)\}} \quad (55)$$

The signal sub-matrices $Y_{PD,OUT,IA}(k)\in\mathbb{R}^{Q_{PD}(k-1)\times L}$ and $Y_{PD,IN,IA}(k)\in\mathbb{R}^{Q_{PD}(k)\times L}$ in eq.(43) and (44) are supposed to contain the active directional signals extracted from the frame $\hat{Y}(k)$ of gain corrected signals according to the ordering functions $f_{PD,ORD,k-1}$ and $f_{PD,ORD,k}$, respectively, which are faded out or in appropriately, as in eq.(18) and (19).

In particular, the samples $Y_{PD,OUT,IA,i}(k,l)$, $1\leq j\leq Q_{PD}(k-1)$, $1\leq l\leq L$, of the signal matrix $Y_{PD,OUT,IA}(k)$ are computed from the samples of the frame $\hat{Y}(k)$ of gain corrected signals by $$y_{PD,OUT,IA,i}(k,l)=\hat{y}_{f_{PD,ORD,k-1}(i)^{-1}}(k,l)\cdot w_{DIR}(L+l) \quad (56)$$

Similarly, the samples $y_{PD,IN,IA,i}(k,l)$, $1\leq j\leq Q_{PD}(k)$, $1\leq l\leq L$, of the signal matrix $Y_{PD,IN,IA}(k)$ are computed from the samples of the frame $\hat{Y}(k)$ of gain corrected signals by $$y_{PD,OUT,IA,i}(k,l)=\hat{y}_{f_{PD,ORD,k-1}(i)^{-1}}(k,l)\cdot w_{DIR}(l) \quad (57)$$

The signal sub-matrices $Y_{PD,OUT,E}(k)\in\mathbb{R}^{Q_{PD}(k-1)\times L}$ and $Y_{PD,OUT,D}(k)\in\mathbb{R}^{Q_{PD}(k-1)\times L}$ are then created from $Y_{PD,OUT,IA}(k)$ by applying an additional fade out and fade in, respectively. Similarly the sub-matrices $Y_{PD,IN,E}(k)\in\mathbb{R}^{Q_{PD}(k)\times L}$ and $Y_{PD,IN,D}(k)\in\mathbb{R}^{Q_{PD}(k)\times L}$ are computed from $Y_{PD,IN,IA}(k)$ by applying an additional fade out and fade in, respectively.

In detail, the samples $y_{PD,OUT,E,i}(k,l)$ and $y_{PD,OUT,D,i}(k,l)$, $1\leq j\leq Q_{PD}(k-1)$, of the signal sub-matrices $Y_{PD,OUT,E}(k)$ and $Y_{PD,OUT,D}(k)$ are computed by $$y_{PD,OUT,E,i}(k,l)=y_{PD,OUT,IA,i}(k,l)\cdot w_{DIR}(L,l) \quad (58)$$

$$y_{PD,OUT,D,i}(k,l)=y_{PD,OUT,IA,i}(k,l)\cdot w_{DIR}(l) \quad (59)$$

Accordingly, the samples $y_{PD,IN,E,i}(k,l)$ and $y_{PD,IN,D,i}(k,l)$, $1\leq j\leq Q_{PD}(k)$, of the signal sub-matrices $Y_{PD,IN,E}(k)$ and $Y_{PD,IN,D}(k)$ are computed by $$y_{PD,IN,E,i}(k,l)=y_{PD,IN,IA,i}(k,l)\cdot w_{DIR}(L+l) \quad (60)$$

$$y_{PD,IN,D,i}(k,l)=y_{PD,IN,IA,i}(k,l)\cdot w_{DIR}(l) \quad (61)$$

3.1.2.1.1 Exemplary Computation of the Matrix for Weighting of Mode Vectors

Since the computation of the matrix $A_{WEIGH}(k)$ may appear complicated and confusing at first sight, an example for its computation is provided in the following. We assume for simplicity an HOA order of N=2 and that the matrices $P_{IND}(k)$ and $P_F(k)$ specifying the spatial prediction are given by $$P_{IND}(k)=\begin{bmatrix}1&0&1&0&3&0&3&0&0\\3&0&0&0&0&0&1&0&0\end{bmatrix} \quad (62)$$

$$P_F(k)=\begin{bmatrix}\frac{3}{8}&0&-\frac{7}{8}&0&\frac{5}{8}&0&-\frac{3}{4}&0&0\\\frac{1}{2}&0&0&0&0&0&\frac{1}{8}&0&0\end{bmatrix} \quad (63)$$

The first columns of these matrices have to be interpreted such that the predicted directional signal for direction $\Omega_N^{(1)}$ is obtained from a weighted sum of directional signals with indices 1 and 3, where the weighting factors are given by ⅜ and ½, respectively.

Under this exemplary assumption, the set of indices of all active directional signals involved in the spatial prediction is given by $$\mathcal{J}_{PD}(k)==\{1,3\} \quad (64)$$

A possible bijective function for ordering the elements of this set is given by $$f_{PD,ORD,k}:\mathcal{J}_{PD}(k)\rightarrow\{1,2\},f_{PD,ORD,k}(1)=1,f_{PD,ORD,k}(3)=2 \quad (65)$$

The matrix $A_{WEIGH}(k)$ is in this case given by $$A_{WEIGH}(k) = \begin{bmatrix} \frac{3}{8} & \frac{1}{2} \\ 0 & 0 \\ -\frac{7}{8} & 0 \\ 0 & 0 \\ 0 & \frac{5}{8} \\ 0 & 0 \\ \frac{1}{8} & -\frac{3}{4} \\ 0 & 0 \\ 0 & 0 \end{bmatrix} \tag{66}$$

where the first column contains the factors related to the weighting of the directional signal with index 1 and the second column contains the factors related to the weighting of the directional signal with index 3.

3.1.2.2 Combined Synthesis and Rendering of HOA Representation of Active Directional Signals 622

The computation of the frame $\hat{W}_{DIR}(k)$ is expressed by a single matrix multiplication according to $$\hat{W}_{DIR}(k)=A_{DIR}(k)\cdot Y_{DIR}(k) \tag{67}$$

where, in principle, the columns of the matrix $A_{DIR}(k)\in\mathbb{R}^{L_S\times(Q_{DIR}(k-1)+Q_{DIR}(k))}$ describe the panning of the active directional signals, contained in the signal matrix $Y_{DIR}(k)\in\mathbb{R}^{(Q_{DIR}(k-1)+Q_{DIR}(k))\times L}$ to the loudspeakers.

Both matrices, $A_{DIR}(k)$ and $Y_{DIR}(k)$, consist each of two components, i.e. one component for the faded out contribution from the last frame and one component for the faded in contribution from the current frame:

$$A_{DIR}(k) = [\ A_{DIR,PAN}(k-1) \quad A_{DIR,PAN}(k)\ ] \tag{68}$$

$$Y_{DIR}(k) = \begin{bmatrix} Y_{DIR,OUT}(k) \\ Y_{DIR,IN}(k) \end{bmatrix} \tag{69}$$

The number $Q_{DIR}(k)$ of columns of $A_{DIR,PAN}(k)\in\mathbb{R}^{L_S\times Q_{DIR}(k)}$ is equal to the number of rows of $Y_{DIR,OUT}(k)\in\mathbb{R}^{Q_{DIR}(k)\times L}$, and corresponds to the number of elements of the set $\mathcal{I}_{DIR,NZ}(k)$ defined in Sec. 2.1, i.e.

$$Q_{DIR}(k)=|\mathcal{I}_{DIR,NZ}(k)| \tag{70}$$

Correspondingly, the number of rows of $Y_{DIR,IN}(k)\in\mathbb{R}^{Q_{DIR}(k-1)\times L}$ is equal to $Q_{DIR}(k-1)$. The matrix $A_{DIR,PAN}(k)$ is computed by the product $$A_{DIR,PAN}(k)=D\cdot\Psi_{DIR}(k) \tag{71}$$

where the columns of $\Psi_{DIR}(k)\in\mathbb{R}^{O\times Q_{DIR}(k)}$ consist of mode vectors with respect to (valid non-zero) directions contained in the second elements of the tuples in $\mathcal{M}_{DIR}(k)$. The order of the mode vectors is arbitrary in principle, however, must match with the order of the corresponding signals assigned to the signal matrix $Y_{DIR}(k)$.

In particular, if we assume any ordering being defined by the following bijective function $$f_{DIR,ORD,k}:\mathcal{I}_{DIR,NZ}(k)\rightarrow\{1,\ldots,Q_{DIR}(k)\} \tag{72}$$

the j-th column of $\Psi_{DIR}(k)$ is set to the mode vector corresponding to the direction represented by that tuple in $\mathcal{M}_{DIR}(k)$ of which the first element is equal to $f_{DIR,ORD,k}^{-1}(j)$. Since there are 900 possible directions in total, of which the mode matrix $\Psi^{(N,29)}$ is assumed to be precomputed at an initialization phase, the j-th column of $\Psi_{DIR}(k)$ can also be expressed by $$\Psi_{DIR}(k)|_j=\Psi^{(N,29)}|_{\Omega_{QUANT,d(k)}}\ s.t.\ d=f_{DIR,ORD,k-1}^{-1}(j) \tag{73}$$

The signal matrices $Y_{DIR,OUT}(k)$ and $Y_{DIR,OUT}(k)$ contain the active directional signals extracted from the frame $\hat{Y}(k)$ of gain corrected signals according to the ordering functions $f_{DIR,ORD,k-1}$ and $f_{DIR,ORD,k}$, respectively, which faded out or in appropriately (as in eq.(11) and (12)).

In particular, the samples $y_{DIR,OUT,j}(k,l)$, $1\leq j\leq Q_{DIR}(k-1)$, $1\leq l\leq L$, of the signal matrix $Y_{DIR,OUT}(k)$ are computed from the samples of the frame $\hat{Y}(k)$ of gain corrected signals by $$y_{DIR,OUT,j}(k,l) = \hat{y}_{f_{DIR,ORD,k-1}^{-1}(j)}(k,l)\cdot\begin{cases} w_{DIR}(L+l) & \text{if } f_{DIR,ORD,k-1}^{-1}(j)\in\mathcal{J}_{DIR,NZ}(k) \\ w_{VEC}(L+l) & \text{if } f_{DIR,ORD,k-1}^{-1}(j)\in\mathcal{J}_{VEC}(k) \\ 1 & \text{else} \end{cases} \tag{74}$$

Similarly, the samples $y_{DIR,IN,j}(k,l)$, $1\leq j\leq Q_{DIR}(k)$, $1\leq l\leq L$, of the signal matrix $Y_{DIR,IN}(k)$ are computed by $$y_{DIR,IN,j}(k,l) = \hat{y}_{f_{DIR,ORD,k}^{-1}(j)}(k,l)\cdot\begin{cases} w_{DIR}(l) & \text{if } f_{DIR,ORD,k}^{-1}(j)\in\mathcal{J}_{DIR}(k-1)\cup\mathcal{J}_{VEC}(k-1) \\ 1 & \text{else} \end{cases} \tag{75}$$

3.1.2.3 Combined Synthesis and Rendering of HOA Representation of Active Vector Based Signals 623

The combined synthesis and rendering of HOA representation of active vector based signals 623 is very similar to the combined synthesis and rendering of HOA representation of predicted directional signals, described above in Sec.4.1.2. In particular, the vectors defining the directional distributions of monaural signals, which are referred to as vector based signals, are here directly given, whereas they had to be intermediately computed for the combined synthesis and rendering of HOA representation of predicted directional signals.

Further, in case that vectors representing the spatial distribution of vector based signals have been coded in a special mode (i.e. CodedVVecLength=1), a fading in or out is performed for certain coefficient sequences of the reconstructed HOA component of the vector based signals (see eq.(26)). This issue has not been considered in [1, Sec. 12.4.2.4.4], ie. the proposal therein does not work for the mentioned case.

Similar to the above-described solution for the combined synthesis and rendering of HOA representation of predicted directional signals, it is proposed to solve this issue by introducing three different types of active vector based signals, namely non-faded, faded out and faded in ones. For all signals of each type, a special panning matrix is then computed by involving from the HOA rendering matrix and from the HOA representation only the coefficient sequences with the appropriate indices, namely indices of non-transmitted ambient HOA coefficient sequences contained in $\mathcal{I}_{1,A}(k)$, and indices of faded out or faded in ambient HOA coefficient sequences contained in $\mathcal{I}_D(k)$ and $\mathcal{I}_E(k)$, respectively.

In detail, the computation of the frame $\hat{W}_{VEC}(k)$ of the loudspeaker signals corresponding to the HOA representation of predicted directional signals is expressed by a single matrix multiplication according to $$\hat{W}_{VEC}(k)=A_{VEC}(k)\cdot Y_{VEC}(k) \tag{76}$$

Both matrices, $A_{VEC}(k)$ and $Y_{VEC}(k)$, consist each of two components, i.e. one component for the faded out contribution from the last frame and one component for the faded in contribution from the current frame:

$$A_{VEC}(k) = [\, A_{VEC,OUT}(k) \quad A_{VEC,IN}(k)] \tag{77}$$

$$Y_{VEC}(k) = \begin{bmatrix} Y_{VEC,OUT}(k) \\ Y_{VEC,IN}(k) \end{bmatrix} \tag{78}$$

Each sub matrix itself is assumed to consist of three components as follows, related to the three previously mentioned types of active vector based signals, namely non-faded, faded out and faded in ones:

$$A_{VEC,OUT}(k) = [\, A_{VEC,OUT,IA}(k) \quad A_{VEC,OUT,E}(k) \quad A_{VEC,OUT,D}(k)\,] \tag{79}$$

$$A_{VEC,IN}(k) = [\, A_{VEC,IN,IA}(k) \quad A_{VEC,IN,E}(k) \quad A_{VEC,IN,D}(k)\,] \tag{80}$$

$$Y_{VEC,OUT}(k) = \begin{bmatrix} Y_{VEC,OUT,IA}(k) \\ Y_{VEC,OUT,E}(k) \\ Y_{VEC,OUT,D}(k) \end{bmatrix} \tag{81}$$

$$Y_{VEC,IN}(k) = \begin{bmatrix} Y_{VEC,IN,IA}(k) \\ Y_{VEC,IN,E}(k) \\ Y_{VEC,IN,D}(k) \end{bmatrix} \tag{82}$$

Each sub-matrix component with label "IA", "E" and "D" is associated with the set $\mathcal{J}_{IA}(k)$, $\mathcal{J}_{E}(k)$, and $\mathcal{J}_{D}(k)$, and is assumed to be not existent in the case the corresponding set is empty.

To compute the individual sub-matrix components, we first compose the matrix $V_{VEC}(k)\in\mathbb{R}^{Q_{VEC}(k)\times k}$ from the $Q_{VEC}(k):=|\mathcal{J}_{VEC}(k)|$ vectors contained in the second elements of the tuples of $\mathcal{M}_{VEC}(k)$. The order of the vectors is arbitrary in principle, however, must match with the order of the corresponding signals assigned to the signal matrix $Y_{VEC,IN,IA}(k)$. In particular, if we assume any ordering being defined by the following bijective function $$f_{VEC,ORD,k}:\ \mathcal{M}_{VEC}(k)\rightarrow\{1,\ldots,Q_{VEC}(k)\} \tag{83}$$

the j-th column of $V_{VEC}(k)$ is set to the vector represented by that tuple in $\mathcal{M}_{VEC}(k)$ of which the first element is equal to $f_{VEC,ORD,k}^{-1}(j)$.

The components of the matrices $A_{VEC,OUT}(k)$ and $A_{VEC,IN}(k)$ in eq.(79) and (80) are finally obtained by multiplying appropriate sub-matrices of the rendering matrix D with appropriate sub-matrices of the matrix $V_{VEC}(k-1)$ or $V_{VEC}(k)$ representing the directional distribution of the active vector based signals, i.e.

$$A_{VEC,OUT,IA}(k)=\boldsymbol{D}^{\downarrow\{\mathcal{J}_{IA}(k)\}}\cdot V_{VEC}(k-1)^{\leftarrow\{\mathcal{J}_{IA}(k)\}} \tag{84}$$

$$A_{VEC,OUT,E}(k)=\boldsymbol{D}^{\downarrow\{\mathcal{J}_{E}(k)\}}\cdot V_{VEC}(k-1)^{\leftarrow\{\mathcal{J}_{E}(k)\}} \tag{85}$$

$$A_{VEC,OUT,D}(k)=\boldsymbol{D}^{\downarrow\{\mathcal{J}_{D}(k)\}}\cdot V_{VEC}(k-1)^{\leftarrow\{\mathcal{J}_{D}(k)\}} \tag{86}$$

and $$A_{VEC,IN,IA}(k)=\boldsymbol{D}^{\downarrow\{\mathcal{J}_{IA}(k)\}}\cdot V_{VEC}(k)^{\leftarrow\{\mathcal{J}_{IA}(k)\}} \tag{87}$$

$$A_{VEC,IN,E}(k)=\boldsymbol{D}^{\downarrow\{\mathcal{J}_{E}(k)\}}\cdot V_{VEC}(k)^{\leftarrow\{\mathcal{J}_{E}(k)\}} \tag{88}$$

$$A_{VEC,OUT,D}(k)=\boldsymbol{D}^{\downarrow\{\mathcal{J}_{D}(k)\}}\cdot V_{VEC}(k)^{\leftarrow\mathcal{J}_{D}(k)\}} \tag{89}$$

The signal sub-matrices and $Y_{VEC,OUT,IA}(k)\in\mathbb{R}^{Q_{VEC}(k-1)\times L}$ and $Y_{VEC,IN,IA}(k)\in\mathbb{R}^{Q_{VEC}(k)\times L}$ in eq. (81) and (82) are supposed to contain the active vector based signals extracted from the frame Y(k) of gain corrected signals according to the ordering functions $f_{VEC,ORD,k-1}$ and $f_{VEC,ORD,k}$, respectively, which are faded out or in appropriately, as in eq.(24) and (25).

In particular, the samples $y_{VEC,OUT,IA,j}(k,l)$, $1\le j\le Q_{VEC}(k-1)$, $1\le l\le L$, of the signal matrix $Y_{VEC,OUT,IA}(k)$ are computed from the samples of the frame $\hat{Y}(k)$ of gain corrected signals by $$y_{VEC,OUT,IA,j}(k,l) = \hat{y}_{f_{PD,ORD,k-1}^{-1}(i)}(k,l)\cdot\begin{cases} w_{DIR}(L+l) & \text{if } f_{PD,ORD,k-1}^{-1}(i)\in\mathcal{J}_{DIR}(k) \\ w_{VEC}(L+l) & \text{if } f_{PD,ORD,k-1}^{-1}(i)\in\mathcal{J}_{VEC}(k) \\ 0 & \text{else} \end{cases}. \tag{90}$$

Similarly, the samples $y_{VEC,IN,IA,j}(k,l)$, $1\le j\le Q_{VEC}(k)$, $1\le l\le L$, of the signal matrix $Y_{VEC,IN,IA}(k)$ are computed from the samples of the frame $\hat{Y}(k)$ of gain corrected signals by $$y_{VEC,IN,IA,j}(k,l) = \hat{y}_{f_{VEC,ORD,k}^{-1}(i)}(k,l)\cdot\begin{cases} w_{VEC}(l) & \text{if } f_{VEC,ORD,k}^{-1}(i)\in\mathcal{J}_{DIR}(k-1)\cup\mathcal{J}_{VEC}(k-1) \\ 1 & \text{else} \end{cases}. \tag{91}$$

The signal sub-matrices and $Y_{VEC,OUT,E}(k)\in\mathbb{R}^{Q_{VEC}(k-1)\times L}$ and $Y_{VEC,OUT,D}(k)\in\mathbb{R}^{Q_{VEC}(k-1)\times L}$ are then created from $Y_{VEC,OUT,IA}(k)$ by applying an additional fade out and fade in, respectively. Similarly the sub-matrices $Y_{VEC,IN,E}(k)\in\mathbb{R}^{Q_{VEC}(k)\times L}$ and $Y_{VEC,IN,D}(k)\in\mathbb{R}^{Q_{VEC}(k)\times L}$ are computed from $Y_{VEC,IN,IA}(k)$ by applying an additional fade out and fade in, respectively.

In detail, the samples $y_{VEC,OUT,E,i}(k,l)$ and $y_{VEC,OUT,D,i}(k,l)$, $1\le j\le Q_{VEC}(k-1)$, of the signal sub-matrices $Y_{VEC,OUT,E}(k)$ and $Y_{VEC,OUT,D}(k)$ are computed by $$y_{VEC,OUT,E,i}(k,l)=y_{VEC,OUT,IA,i}(k,l)\cdot w_{DIR}(L+l) \tag{92}$$

$$y_{VEC,OUT,D,i}(k,l)=y_{VEC,OUT,IA,i}(k,l)\cdot w_{DIR}(l) \tag{93}$$

Accordingly, the samples $y_{VEC,IN,E,i}(k,l)$ and $y_{VEC,IN,D,i}(k,l)$, $1\le j\le Q_{VEC}(k)$, of the signal sub-matrices $Y_{VEC,IN,E}(k)$ and $Y_{VEC,IN,D}(k)$ are computed by $$y_{VEC,IN,E,i}(k,l)=y_{VEC,IN,IA,i}(k,l)\cdot w_{DIR}(L+l) \tag{94}$$

$$Y_{VEC,IN,D,i}(k,l)=y_{VEC,IN,IA,i}(k,l)\cdot w_{DIR}(l) \tag{95}$$

3.1.3 Exemplary Practical Implementation

Eventually, it is pointed out that the most computationally demanding part of each processing block of the disclosed combined HOA synthesis and rendering may be expressed by a simple matrix multiplication (see eq.(31), (38), (67) and (76)). Hence, for an exemplary practical implementation, it is possible to use special matrix multiplication functions optimized with respect to performance. It is in this context also possible to compute the rendered loudspeaker signals of all processing blocks by a single matrix multiplication as $$\hat{W}(k)=A_{ALL}(k)\cdot Y_{ALL}(k) \tag{96}$$

where the matrices $A_{ALL}(k)$ and $Y_{ALL}(k)$ are defined by $$A_{ALL}(k) := [\, A_{AMB}(k) \quad A_{PD}(k) \quad A_{DIR}(k) \quad A_{VEC}(k) \,] \tag{97}$$

$$Y_{ALL}(k) = \begin{bmatrix} Y_{AMB}(k) \\ Y_{PD}(k) \\ Y_{DIR}(k) \\ Y_{VEC}(k) \end{bmatrix} \tag{98}$$

Further, it is also pointed out that, instead of applying the fading before the linear processing of the signals, it is also possible to apply the fading after the linear operations, i.e. to apply the fading to the loudspeaker signals directly. Thus, in an embodiment where perceptually decoded signals $\hat{z}_1(k), \ldots, \hat{z}_I(k)$ represent components of at least two different types that require a linear operation for reconstructing HOA coefficient sequences, wherein for components of a first type a fading of individual coefficient sequences $\hat{C}_{AMB}(k)$, $C_{DIR}(k)$ is not required for the reconstructing, and for components of a second type a fading of individual coefficient sequences $C_{PD}(k)$, $C_{VEC}(k)$ is required for the reconstructing, three different versions of loudspeaker signals are created by applying first, second and third linear operations (i.e. without fading) respectively to a component of the second type of the perceptually decoded signals, and then applying no fading to the first version of loudspeaker signals, a fading-in to the second version of loudspeaker signals and a fading-out to the third version of loudspeaker signals. The results are superimposed (e.g. added up) to generate the second loudspeaker signals $\hat{W}_{PD}(k)$, $\hat{W}_{VEC}(k)$.

In the following Efficiency comparison, we compare the computational demand for the state of the art HOA synthesis with successive HOA rendering with the computational demand for the proposed efficient combination of both processing blocks. For simplicity reasons, the computational demand is measured in terms of required multiplication (or combined multiplication and addition) operations, disregarding the distinctly less costly pure addition operations.

For both kinds of processing, the required numbers of multiplications for each individual sub-processing block together with the corresponding equation numbers expressing the computation are given in Tab.1 and Tab.2, respectively, For the combined synthesis and rendering of the HOA representation of vector based signals we have assumed that the corresponding vectors are coded with the option CodedVVecLength=1 (see [1, Sec. 12.4.1.10.2]).

TABLE 1

Computational demand for state of the art HOA synthesis with successive HOA rendering

| Processing name | Req. multiplications | Reference equations |
|---|---|---|
| Ambience synthesis (Sec. 2.1.2) | $O_{MIN}^2 \cdot L$ | (7) |
| Predominant sound synthesis (Sec. 2.1.3) | | |
| Synthesis of directional signals (Sec. 2.1.3.1) | $2 \cdot (Q_{DIR}(k-1) + Q_{DIR}(k)) \cdot O \cdot L$ | (10), (11), (12) |
| Synthesis of predicted directional signals (Sec. 2.1.3.2) | $2 \cdot O \cdot L \cdot (D_{PRED} + 1)$<br>$O^2 \cdot L$<br>$(\lvert \mathcal{I}_D(k) \rvert + \lvert \mathcal{I}_E(k) \rvert) \cdot L$ | (17), (18), (19)<br>(20)<br>(21) |
| Synthesis of vector based signals (Sec. 2.1.3.3) | $2 \cdot L \cdot O \cdot (Q_{VEC}(k-1) + Q_{VEC}(k))$<br>$(\lvert \mathcal{I}_D(k) \rvert + \lvert \mathcal{I}_E(k) \rvert) \cdot L$ | (23), (24), (25)<br>(26) |
| HOA renderer (Sec. 3) | $O \cdot L_S \cdot L$ | (29) |

TABLE 2

Computational demand for proposed combined HOA synthesis and rendering

| Processing name<br>Combined synthesis and rendering of | Req. multiplications | Reference equations |
|---|---|---|
| Ambient HOA component (Sec. 4.1.1) | $Q_{AMB}(k) \cdot L_S \cdot L$ | (31) |
| HOA representation of predicted directional signals (Sec. 4.1.2.1) | $3 \cdot (Q_{PD}(k-1) + Q_{PD}(k)) \cdot L_S \cdot L$<br>$O^2 \cdot Q_{PD}(k)$<br>$(\lvert \mathcal{I}_{IA}(k) \rvert + \lvert \mathcal{I}_E(k) \rvert + \lvert \mathcal{I}_D(k) \rvert) \cdot L_S \cdot (Q_{PD}(k-1) + Q_{PD}(k))$<br>$3 \cdot (Q_{PD}(k-1) + Q_{PD}(k)) \cdot L$ | (38)<br>(49)<br>(50)-(55)<br>(56)-(61) |
| HOA representation of directional signals (Sec. 4.1.2.2) | $(Q_{DIR}(k-1) + Q_{DIR}(k)) \cdot L_S \cdot L$<br>$O \cdot Q_{DIR}(k) \cdot L_S$<br>$(Q_{DIR}(k-1) + Q_{DIR}(k)) \cdot L$ | (67)<br>(71)<br>(74), (75) |
| HOA representation of vector based signals (Sec. 4.1.2.3) | $3 \cdot (Q_{VEC}(k-1) + Q_{VEC}(k)) \cdot L_S \cdot L$<br>$(\lvert \mathcal{I}_{IA}(k) \rvert + \lvert \mathcal{I}_E(k) \rvert + \lvert \mathcal{I}_D(k) \rvert) \cdot L_S \cdot (Q_{VEC}(k-1) + Q_{VEC}(k))$<br>$3 \cdot (Q_{VEC}(k-1) + Q_{VEC}(k)) \cdot L$ | (76)<br>(84)-(89)<br>(90)-(95) |

For the known processing (see Tab.1), it can be observed that the most demanding blocks are those where the number of multiplications contains as factors the frame length L in combination with the number O of HOA coefficient sequences, since the possible values of L (typically 1024 or 2048) are much greater compared to the values of other quantities. For the synthesis of predicted directional signals (Sec.2.1.3.2) the number O of HOA coefficient sequences is even involved by its square, and for the HOA renderer the number $L_S$ of loudspeakers occurs as an additional factor.

On the contrary, for the proposed computation (see Tab.2), the most demanding blocks do not depend on the number O of HOA coefficient sequences, but instead on the number $L_S$ of loudspeakers. That means that the overall computational demand for the combined HOA synthesis and rendering is only negligibly dependent of the HOA order N.

Eventually, in Tab.3 and Tab.4 we provide for both processing methods the required numbers of millions of (multiplication or combined multiplication and addition) operations per second (MOPS) for a typical scenario assuming

- a sampling rate of $f_S$=48 kHz
- $O_{MIN}$=4
- a frame length of L=1024 samples
- I=9 transport signals containing in total $Q_{AMB}(k)$=5 coefficient sequences of the ambient HOA component (i.e. $\mathcal{I}_{IA}(k)|=O-Q_{AMB}(k)=20$), $Q_{DIR}(k)=Q_{DIR}(k-1)=2$ directional signals and $Q_{VEC}(k)=Q_{VEC}(k-1)=2$ vector based signals per frame
- that for each frame all of the directional signals are involved in the spatial prediction ($Q_{PD}(k)=Q_{PD}(k-1)=Q_{DIR}(k)=2$
- as the worst case that in each frame a coefficient sequence of the ambient HOA component is faded out and in (i.e. $|\mathcal{I}_E^{(k)}|=|\mathcal{I}_D(k)|=1$), where we vary the HOA order N and the number of loudspeakers L.

TABLE 3

Exemplary computational demand for state of the art HOA synthesis with successive HOA rendering for $f_S$ = 48 kHz, $O_{MIN}$ = 4, $Q_{AMB}(k)$ = 5, $Q_{DIR}(k) = Q_{DIR}(k-1) = 2$, $Q_{VEC}(k) = Q_{VEC}(k-1) = 2$ and different HOA orders N and numbers of loudspeakers $L_S$.

| | MOPS for | | | | | |
|---|---|---|---|---|---|---|
| | N = 4 | | | N = 6 | | |
| Processing name | $L_S$ = 7 | $L_S$ = 11 | $L_S$ = 22 | $L_S$ = 7 | $L_S$ = 11 | $L_S$ = 22 |
| Ambience synthesis (Sec. 2.1.2) | 0.768 | 0.768 | 0.768 | 0.768 | 0.768 | 0.768 |
| Predominant sound synthesis (Sec. 2.1.3) | | | | | | |
| Synthesis of directional signals (Sec. 2.1.3.1) | 9.6 | 9.6 | 9.6 | 18.816 | 18.816 | 18.816 |
| Synthesis of predicted directional signals (Sec. 2.1.3.2) | 37.296 | 37.296 | 37.296 | 129.456 | 129.456 | 129.456 |
| Synthesis of vector based signals (Sec. 2.1.3.3) | 9.696 | 9.696 | 9.696 | 18.912 | 18.912 | 18.912 |
| HOA renderer (Sec. 3) | 8.4 | 13.2 | 26.4 | 16.464 | 25.872 | 51.744 |
| Total | 65.67 | 70.56 | 83.76 | 184.416 | 193.824 | 219.696 |

TABLE 4

Exemplary computational demand for proposed combined HOA synthesis and rendering for $f_S$ = 48 kHz, $O_{MIN}$ = 4, $Q_{AMB}(k)$ = 5, $Q_{DIR}(k) = Q_{DIR}(k-1) = 2$, $Q_{VEC}(k) = Q_{VEC}(k-1) = 2$ and different HOA orders N and numbers of loudspeakers $L_S$

| Processing name | MOPS for | | | | | |
|---|---|---|---|---|---|---|
| Combined synthesis | N = 4 | | | N = 6 | | |
| and rendering of | $L_S$ = 7 | $L_S$ = 11 | $L_S$ = 22 | $L_S$ = 7 | $L_S$ = 11 | $L_S$ = 22 |
| ambient HOA component (Sec. 4.1.1) | 1.68 | 2.64 | 5.28 | 1.68 | 2.64 | 5.28 |
| HOA representation of predicted directional signals (Sec. 4.1.2.1) | 4.695 | 7.016 | 13.397 | 4.893 | 7.232 | 13.662 |
| HOA representation of directional signals (Sec. 4.1.2.2) | 1.552 | 2.33 | 4.468 | 1.568 | 2.354 | 4.517 |

TABLE 4-continued

Exemplary computational demand for proposed combined HOA synthesis and rendering for $f_S$ = 48 kHz, $O_{MIN}$ = 4, $Q_{AMB}(k)$ = 5, $Q_{DIR}(k)$ = $Q_{DIR}(k-1)$ = 2, $Q_{VEC}(k)$ = $Q_{VEC}(k-1)$ = 2 and different HOA orders N and numbers of loudspeakers $L_S$

| Processing name | MOPS for | | | | | |
|---|---|---|---|---|---|---|
| Combined synthesis | N = 4 | | | N = 6 | | |
| and rendering of | $L_S$ = 7 | $L_S$ = 11 | $L_S$ = 22 | $L_S$ = 7 | $L_S$ = 11 | $L_S$ = 22 |
| HOA representation of vector based signals (Sec. 3.1.2.3) | 4.637 | 6.957 | 13.339 | 4.668 | 7.007 | 13.438 |
| Total | 12.565 | 18.943 | 36.484 | 12.81 | 19.233 | 36.898 |

From Tab.3 it can be observed that the computational demand for state of the art HOA synthesis with successive HOA rendering distinctly grows with the HOA order N, where the most demanding processing blocks are the synthesis of predicted directional signals and the HOA renderer. On the contrary, the results for the proposed combined HOA synthesis and rendering shown in Tab.4 confirm that its computational demand only negligibly depends on the HOA order N. Instead, there is an approximately proportional dependence on the number of loudspeakers $L_S$. In particular important, for all exemplary cases the computational demand for the proposed method is considerably lower than that of the state of the art method.

It is noted that the above-described inventions can be implemented in various embodiments, including methods, devices, storage media, signals and others.

In particular, various embodiments of the invention comprise the following.

In an embodiment, a method for frame-wise combined decoding and rendering an input signal comprising a compressed HOA signal to obtain loudspeaker signals, wherein a HOA rendering matrix D according to a given loudspeaker configuration is computed and used, comprises for each frame demultiplexing 10 the input signal into a perceptually coded portion and a side information portion, perceptually decoding 20 in a perceptual decoder the perceptually coded portion, wherein perceptually decoded signals $\hat{z}_1(k), \ldots, \hat{z}_I(k)$ are obtained that represent two or more components of at least two different types that require a linear operation for reconstructing HOA coefficient sequences, wherein no HOA coefficient sequences are reconstructed, and wherein for components of a first type a fading of individual coefficient sequences $\hat{C}_{AMB}(k)$, $C_{DIR}(k)$ is not required for said reconstructing, and for components of a second type a fading of individual coefficient sequences $C_{PD}(k)$, $C_{VEC}(k)$ is required for said reconstructing, decoding 30 in a side information decoder the side information portion, wherein decoded side information is obtained, applying linear operations 61,622 that are individual for each frame, to components of the first type (corresponding to a subset of $\hat{z}_1(k), \ldots, \hat{z}_I(k)$ in FIG. 1, FIG. 3 to intermediately create $\hat{C}_{AMB}(k)$, $C_{DIR}(k)$) to generate first loudspeaker signals $\hat{W}_{AMB}(k)$, $\hat{W}_{DIR}(k)$, determining, according to the side information and individually for each frame, for each component of the second type three different linear operations, with a linear operation ($A_{PD,OUT,I4}(k)$, $A_{PD,IN,I4}(k)$ or $A_{VEC,OUT,I4}(k)$, $A_{VEC,IN,I4}(k)$) being for coefficient sequences that according to the side information require no fading, a linear operation ($A_{PD,OUT,D}(k)$, $A_{PD,IN,D}(k)$ or $A_{VEC,OUT,D}(k)$, $A_{VEC,IN,D}(k)$) being for coefficient sequences that according to the side information require fading-in, and a linear operation ($A_{PD,OUT,E}(k)$, $A_{PD,IN,E}(k)$ or $A_{VEC,OUT,E}(k)$, $A_{VEC,IN,E}(k)$) being for coefficient sequences that according to the side information require fading-out, generating from the perceptually decoded signals belonging to each component of the second type (corresponding to a subset of $\hat{z}_1(k), \ldots, \hat{z}_I(k)$ in FIG. 1, FIG. 3 to intermediately create $C_{PD}(k)$, $C_{VEC}(k)$) three versions, wherein a first version ($Y_{PD,OUT,I4}(k)$, $Y_{PD,IN,I4}(k)$ or $Y_{VEC,OUT,I4}(k)$, $Y_{VEC,IN,I4}(k)$) comprises the original signals of the respective component, which are not faded, a second version ($Y_{PD,OUT,D}(k)$, $Y_{PD,IN,D}(k)$ or $Y_{VEC,OUT,D}(k)$, $Y_{VEC,IN,D}(k)$) of signals is obtained by fading-in the original signals of the respective component, and a third version ($Y_{PD,OUT,E}(k)$, $Y_{PD,IN,E}(k)$ or $Y_{VEC,OUT,E}(k)$, $Y_{VEC,IN,E}(k)$) of signals is obtained by fading out the original signals of the respective component, applying to each of said first, second and third versions of said perceptually decoded signals the respective linear operation (as e.g. for PD in eq.38-44) and superimposing (e.g. adding up) the results to generate second loudspeaker signals $\hat{W}_{PD}(k)$, $\hat{W}_{VEC}(k)$, adding 624,63 the first and second loudspeaker signals $\hat{W}_{AMB}(k)$, $\hat{W}_{PD}(k)$, $\hat{W}_{DIR}(k)$, $\hat{W}_{VEC(k)}$, wherein the loudspeaker signals $\hat{W}(k)$ of a decoded input signal are obtained.

In an embodiment, the method further comprises performing inverse gain control 41,42 on the perceptually decoded signals $\hat{z}_1(k), \ldots, \hat{z}_I(k)$, wherein a portion $e_1(k), \ldots, e_I(k)$, $\beta_1(k), \ldots, \beta_I(k)$ of the decoded side information is used.

In an embodiment, for components of the second type of the perceptually decoded signals (corresponding to a subset of $\hat{z}_1(k), \ldots, \hat{z}_I(k)$ to intermediately create $C_{PD}(k)$, $C_{VEC}(k)$) three different versions of loudspeaker signals are created by applying said first, second and third linear operations (i.e. without fading) respectively to a component of the second type of the perceptually decoded signals, and then applying no fading to the first version of loudspeaker signals, a fading-in to the second version of loudspeaker signals and a fading-out to the third version of loudspeaker signals, and wherein the results are superimposed (e.g. added up) to generate the second loudspeaker signals $\hat{W}_{PD}(k)$, $\hat{W}_{VEC}(k)$.

In an embodiment, the linear operations 61,622 that are applied to components of the first type are a combination of first linear operations that transform the components of the first type to HOA coefficient sequences and second linear operations that transform the HOA coefficient sequences, according to the rendering matrix D, to the first loudspeaker signals.

In an embodiment, an apparatus for frame-wise combined decoding and rendering an input signal comprising a compressed HOA signal to obtain loudspeaker signals, wherein a HOA rendering matrix D according to a given loudspeaker configuration is computed and used, comprises a processor and a memory storing instructions that, when executed on the processor, cause the apparatus to perform for each frame demultiplexing 10 the input signal into a perceptually coded portion and a side information portion perceptually decoding 20 in a perceptual decoder the perceptually coded portion, wherein perceptually decoded signals $\hat{z}_1(k), \ldots, \hat{z}_I(k)$ are obtained that represent two or more components of at least two different types that require a linear operation for reconstructing HOA coefficient sequences, wherein no HOA coefficient sequences are reconstructed, and wherein for components of a first type a fading of individual coefficient sequences $\hat{C}_{AMB}(k)$, $C_{DIR}(k)$ is not required for said reconstructing, and for components of a second type a fading of individual coefficient sequences $C_{PD}(k)$, $C_{VEC}(k)$ is required for said reconstructing, decoding 30 in a side information decoder the side information portion, wherein decoded side information is obtained, applying linear operations 61,622 that are individual for each frame, to components of the first type to generate first loudspeaker signals $\hat{W}_{AMB}(k)$, $\hat{W}_{DIR}(k)$, determining, according to the side information and individually for each frame, for each component of the second type three different linear operations, with a linear operation $A_{PD,OUT,IA}(k)$, $A_{PD,IN,IA}(k)$ or $A_{VEC,OUT,IA}(k)$, $A_{VEC,IN,IA}(k)$ being for coefficient sequences that according to the side information require no fading, a linear operation $A_{PD,OUT,D}(k)$, $A_{PD,IN,D}(k)$ or $A_{VEC,OUT,D}(k)$, $A_{VEC,IN,D}(k)$ being for coefficient sequences that according to the side information require fading-in, and a linear operation $A_{PD,OUT,E}(k)$, $A_{PD,IN,E}(k)$ or $A_{VEC,OUT,E}(k)$, $A_{VEC,IN,E}(k)$ being for coefficient sequences that according to the side information require fading-out, generating from the perceptually decoded signals belonging to each component of the second type three versions, wherein a first version $Y_{PD,OUT,IA}(k)$, $Y_{PD,IN,IA}(k)$ or $Y_{VEC,OUT,IA}(k)$, $Y_{VEC,IN,IA}(k)$ comprises the original signals of the respective component, which are not faded, a second version $Y_{PD,OUT,D}(k)$, $Y_{PD,IN,D}(k)$ or $Y_{VEC,OUT,D}(k)$, $Y_{VEC,IN,D}(k)$ of signals is obtained by fading-in the original signals of the respective component, and a third version $Y_{PD,OUT,E}(k)$, $Y_{PD,IN,E}(k)$ or $Y_{VEC,OUT,E}(k)$, $Y_{VEC,IN,E}(k)$ of signals is obtained by fading out the original signals of the respective component, applying to each of said first, second and third versions of said perceptually decoded signals the respective linear operation (as e.g. for PD in eq.38-44) and superimposing the results to generate second loudspeaker signals $\hat{W}_{PD}(k)$, $\hat{W}_{VEC}(k)$, and adding 624,63 the first and second loudspeaker signals $\hat{W}_{AMB}(k)$, $\hat{W}_{PD}(k)$, $\hat{W}_{DIR}(k)$, $\hat{W}_{VEC}(k)$, wherein the loudspeaker signals $\hat{W}(k)$ of a decoded input signal are obtained.

It is also noted that the components $\hat{W}_{AMB}(k)$, $\hat{W}_{PD}(k)$, $\hat{W}_{DIR}(k)$, $\hat{W}_{VEC}(k)$ of the first and the second loudspeaker signals can be added 624,63 in any combination, e.g. as shown in FIG. 4.

The use of the verb "comprise" and its conjugations does not exclude the presence of elements or steps other than those stated in a claim. Furthermore, the use of the article "a" or "an" preceding an element does not exclude the presence of a plurality of such elements. Several "means" may be represented by the same item of hardware.

While there has been shown, described, and pointed out fundamental novel features of the present invention as applied to preferred embodiments thereof, it will be understood that various omissions, substitutions and changes in the apparatus and method described, in the form and details of the devices disclosed, and in their operation, may be made by those skilled in the art within the scope of the present invention. It is expressly intended that all combinations of those elements that perform substantially the same function in substantially the same way to achieve the same results are within the scope of the invention.

CITED REFERENCES

[1] ISO/IEC JTC1/SC29/WG11 23008-3:2015(E). Information technology—High efficiency coding and media delivery in heterogeneous environments—Part 3: 3D audio, February 2015.

[2] EP 2800401A

[3] EP 2743922A

[4] EP 2665208A

The invention claimed is:

1. Method for frame-wise combined decoding and rendering an input signal comprising a compressed HOA signal to obtain loudspeaker signals, wherein a HOA rendering matrix (D) according to a given loudspeaker configuration is computed and used, the method comprising for each frame demultiplexing the input signal into a perceptually coded portion and a side information portion;

perceptually decoding in a perceptual decoder the perceptually coded portion, wherein perceptually decoded signals $(\hat{z}_1(k), \ldots, \hat{z}_I(k))$ are obtained that represent two or more components of at least two different types that require a linear operation for reconstructing HOA coefficient sequences, wherein no HOA coefficient sequences are reconstructed, and wherein for components of a first type a fading of individual coefficient sequences $(\hat{C}_{AMB}(k), C_{DIR}(k))$ is not required for said reconstructing, and for components of a second type a fading of individual coefficient sequences $(C_{PD}(k), C_{VEC}(k))$ is required for said reconstructing;

decoding in a side information decoder the side information portion, wherein decoded side information is obtained;

applying linear operations that are individual for each frame, to components of the first type to generate first loudspeaker signals $(\hat{W}_{AMB}(k), \hat{W}_{DIR}(k))$;

determining, according to the side information and individually for each frame, for each component of the second type three different linear operations, with a first different linear operation $(A_{PD,OUT,IA}(k), A_{PD,IN,IA}(k), A_{VEC,OUT,IA}(k), A_{VEC,IN,IA}(k))$ being for coefficient sequences that according to the side information require no fading, a second different linear operation $(A_{PD,OUT,D}(k), A_{PD,IN,D}(k), A_{VEC,OUT,D}(k), A_{VEC,IN,D}(k))$ being for coefficient sequences that according to the side information require fading-in, and a third different linear operation $(A_{PD,OUT,E}(k), A_{PD,IN,E}(k), A_{VEC,OUT,E}(k), A_{VEC,IN,E}(k))$ being for coefficient sequences that according to the side information require fading-out;

generating from the perceptually decoded signals belonging to each component of the second type three versions, wherein a first version $(Y_{PD,OUT,IA}(k), Y_{PD,IN,IA}(k), Y_{VEC,OUT,IA}(k), Y_{VEC,IN,IA}(k))$ comprises the original signals of the respective component, which are not faded, a second version $(Y_{PD,OUT,D}(k), Y_{PD,IN,D}(k), Y_{VEC,OUT,D}(k), Y_{VEC,IN,D}(k))$ of signals is obtained by fading-in the original signals of the respective component, and a third version $(Y_{PD,OUT,E}(k), Y_{PD,IN,E}(k),$ $Y_{VEC,OUT,E}(k)$, $Y_{VEC,IN,E}(k)$) of signals is obtained by fading out the original signals of the respective component;

applying to each of said first, second and third versions of said perceptually decoded signals the respective linear operation and superimposing the results to generate second loudspeaker signals ($\hat{W}_{PD}(k)$, $\hat{W}_{VEC}(k)$); and adding the first and second loudspeaker signals ($\hat{W}_{AME}(k)$, $\hat{W}_{PD}(k)$, $\hat{W}_{DIR}(k)$, $\hat{W}_{VEC}(k)$), wherein the loudspeaker signals ($\hat{W}(k)$) of a decoded input signal are obtained.

2. Method according to claim 1, further comprising performing inverse gain control on the perceptually decoded signals, wherein a portion ($e_1(k), \ldots, e_I(k), \beta_1(k), \ldots, \beta_I(k)$) of the decoded side information is used.

3. Method according to claim 1, wherein for components of the second type of the perceptually decoded signals three different versions of loudspeaker different signals are created by applying said first, second and third different linear operations respectively to a component of the second type of the perceptually decoded signals, and then applying no fading to the first version of loudspeaker signals, a fading-in to the second version of loudspeaker signals and a fading-out to the third version of loudspeaker signals, and wherein the results are superimposed to generate the second loudspeaker signals ($\hat{W}_{PD}(k)$, $\hat{W}_{VEC}(k)$).

4. Method according to claim 1, wherein the linear operations that are applied to components of the first type are a combination of first linear operations that transform the components of the first type to HOA coefficient sequences and second linear operations that transform the HOA coefficient sequences, according to the rendering matrix D, to the first loudspeaker signals.

5. An apparatus for frame-wise combined decoding and rendering an input signal comprising a compressed HOA signal, the apparatus comprising a processor and a memory storing instructions that, when executed, cause the apparatus to perform the method steps of claim 1.

6. An apparatus for frame-wise combined decoding and rendering an input signal comprising a compressed HOA signal to obtain loudspeaker signals, wherein a HOA rendering matrix (D) according to a given loudspeaker configuration is computed and used, the apparatus comprising a processor and a memory storing instructions that, when executed, cause the apparatus to perform for each frame demultiplexing the input signal into a perceptually coded portion and a side information portion;

perceptually decoding in a perceptual decoder the perceptually coded portion, wherein perceptually decoded signals ($z_1(k), \ldots, z_I(k)$) are obtained that represent two or more components of at least two different types that require a linear operation for reconstructing HOA coefficient sequences, wherein no HOA coefficient sequences are reconstructed, and wherein for components of a first type a fading of individual coefficient sequences ($C_{AMB}(k)$, $C_{DIR}(k)$) is not required for said reconstructing, and for components of a second type a fading of individual coefficient sequences ($C_{PD}(k)$, $C_{VEC}(k)$) is required for said reconstructing;

decoding in a side information decoder the side information portion, wherein decoded side information is obtained;

applying linear operations that are individual for each frame, to components of the first type to generate first loudspeaker signals ($\hat{W}_{AMB}(k)$, $\hat{W}_{DIR}(k)$);

determining, according to the side information and individually for each frame, for each component of the second type three different linear operations, with a first different linear operation ($A_{PD,OUT,IA}(k)$, $A_{PD,IN,IA}(k)$, $A_{VEC,OUT,IA}(k)$, $A_{VEC,IN,IA}(k)$) being for coefficient sequences that according to the side information require no fading, a second different linear operation ($A_{PD,OUT,D}(k)$, $A_{PD,IN,D}(k)$, $A_{VEC,OUT,D}(k)$, $A_{VEC,IN,D}(k)$) being for coefficient sequences that according to the side information require fading-in, and a third different linear operation ($A_{PD,OUT,E}(k)$, $A_{PD,IN,E}(k)$, $A_{VEC,OUT,E}(k)$, $A_{VEC,IN,E}(k)$) being for coefficient sequences that according to the side information require fading-out;

generating from the perceptually decoded signals belonging to each component of the second type three versions, wherein a first version ($Y_{PD,OUT,IA}(k)$, $Y_{PD,IN,IA}(k)$, $Y_{VEC,OUT,IA}(k)$, $Y_{VEC,IN,IA}(k)$) comprises the original signals of the respective component, which are not faded, a second version ($Y_{PD,OUT,D}(k)$, $Y_{PD,IN,D}(k)$, $Y_{VEC,OUT,D}(k)$, $Y_{VEC,IN,D}(k)$) of signals is obtained by fading-in the original signals of the respective component, and a third version ($Y_{PD,OUT,E}(k)$, $Y_{PD,IN,E}(k)$, $Y_{VEC,OUT,E}(k)$, $Y_{VEC,IN,E}(k)$) of signals is obtained by fading out the original signals of the respective component;

applying to each of said first, second and third versions of said perceptually decoded signals the respective linear operation and superimposing the results to generate second loudspeaker signals ($\hat{W}_{PD}(k)$, $\hat{W}_{VEC}(k)$); and adding the first and second loudspeaker signals ($\hat{W}_{AMB}(k)$, $\hat{W}_{PD}(k)$, $\hat{W}_{DIR}(k)$, $\hat{W}_{VEC}(k)$), wherein the loudspeaker signals ($\hat{W}(k)$) of a decoded input signal are obtained.

7. The apparatus according to claim 6, further comprising performing inverse gain control on the perceptually decoded signals, wherein a portion ($e_1(k), \ldots, e_I(k), \beta_1(k) \ldots \beta_I(k)$) of the decoded side information is used.

8. The apparatus according to claim 6, wherein for components of the second type of the perceptually decoded signals three different versions of loudspeaker different signals are created by applying said first, second and third different linear operations respectively to a component of the second type of the perceptually decoded signals, and then applying no fading to the first version of loudspeaker signals, a fading-in to the second version of loudspeaker signals and a fading-out to the third version of loudspeaker signals, and wherein the results are superimposed to generate the second loudspeaker signals ($\hat{W}_{PD}(k)$, $\hat{W}_{VEC}(k)$).

9. The apparatus according to claim 6, wherein the linear operations that are applied to components of the first type are a combination of first linear operations that transform the components of the first type to HOA coefficient sequences and second linear operations that transform the HOA coefficient sequences, according to the rendering matrix, to the first loudspeaker signals.

* * * * *